US011834318B2

(12) United States Patent
Chen et al.

(10) Patent No.: US 11,834,318 B2
(45) Date of Patent: Dec. 5, 2023

(54) AUTOMATIC LIQUID FILLING SYSTEM AND METHOD

(71) Applicant: TRUSVAL TECHNOLOGY CO., LTD., Zhunan Township (TW)

(72) Inventors: Shih-Feng Chen, Zhunan Township (TW); Shih-Pao Chien, Zhunan Township (TW)

(73) Assignee: TRUSVAL TECHNOLOGY CO., LTD., Zhunan Township (TW)

( * ) Notice: Subject to any disclaimer, the term of this patent is extended or adjusted under 35 U.S.C. 154(b) by 0 days.

(21) Appl. No.: 17/748,605

(22) Filed: May 19, 2022

(65) Prior Publication Data

US 2023/0278846 A1 Sep. 7, 2023

(30) Foreign Application Priority Data

Mar. 1, 2022 (TW) ..... 111107321

(51) Int. Cl.
*B67C 3/34* (2006.01)
*B67C 3/00* (2006.01)

(52) U.S. Cl.
CPC ..... *B67C 3/34* (2013.01); *B67C 3/001* (2013.01); *B67C 3/007* (2013.01)

(58) Field of Classification Search
CPC ..... B67C 3/34
USPC ..... 141/146
See application file for complete search history.

(56) References Cited

U.S. PATENT DOCUMENTS 5,238,034 A 8/1993 Corfitsen
6,382,269 B1 * 5/2002 Tatsuno ..... B67D 7/0401 141/192

FOREIGN PATENT DOCUMENTS

CN 214878695 U 11/2021
CN 113880033 A 1/2022
DE 19849947 C2 * 3/2001 ..... B25J 9/046
TW 201740087 A 11/2017

OTHER PUBLICATIONS

DE-19849947-C2—English Translation (Year: 2001).*
Search Report for TW111107321, dated Jul. 1, 2022, Total of 1 page.
English abstract for CN113880033, Total of 1 page.
English abstract for CN214878695, Total of 1 page.
English abstract for TW201740087, Total of 1 page.

* cited by examiner

*Primary Examiner* — Timothy P. Kelly
*Assistant Examiner* — Christopher M Afful
(74) *Attorney, Agent, or Firm* — Apex Juris, pllc; Hilde Coeckx

(57) ABSTRACT

An automatic liquid filling system includes a machine assembly, a gripping unit, and a controlling unit. The machine assembly has a filling zone for receiving at least one container. The container has an opening. The machine assembly includes a plurality of filling nozzles in the filling zone. The gripping unit in the machine assembly includes a moving track and a robotic arm. The robotic arm is movably disposed on the moving track. The controlling unit in the machine assembly is electrically connected to the gripping unit. When the container is located in the filling zone, the controlling unit controls the robotic arm to move along the moving track and to pick up one of the filling nozzles to fill the container through the opening of the container. A method of filling liquid is provided herewith.

20 Claims, 23 Drawing Sheets

AUTOMATIC LIQUID FILLING SYSTEM AND METHOD

BACKGROUND OF THE INVENTION

Technical Field

The present invention relates generally to a liquid filling technique, and more particularly to an automatic liquid filling system and a method of filing liquid.

Description of Related Art

During a process of processing electronic components, plenty of chemical solutions will be used, such as a developer liquid, an etching liquid, a peel liquid, an antistatic agent, a cleaning liquid, and so on, to remove impurities.

The chemical solutions are liquid, so that the chemical solutions should be stored in the containers for selling and transporting easily. Therefore, an operator of the manufacture of the chemical solution needs to fill the containers with the chemical solution. So far, a process of filling the container is a manual operation. The operator has to operate the liquid filling apparatus to fill the container with the chemical agent.

However, manually filling liquid will consume a lot of manpower, and the efficiency of filling liquid is poor, so there has room for improvement.

BRIEF SUMMARY OF THE INVENTION

In view of the above, the primary objective of the present invention is to provide an automatic liquid filling system and method to automatically fill a container with liquid, which could not only save the manpower, but also promote the efficiency of filling liquid.

The present inventive subject matter provides an automatic liquid filling system including a machine assembly, a gripping unit, and a controlling unit. The machine assembly has a filling zone, wherein the filling zone is adapted to receive a container. The container has an opening. The machine assembly includes a plurality of filling nozzles, and the filling nozzles are located in the filling zone. The gripping unit is disposed in the machine assembly. The gripping unit includes a moving track and a robotic arm. The robotic arm is controlled to move along the moving track. The controlling unit is disposed in the machine assembly and is electrically connected to the gripping unit, wherein when the container is located in the filling zone, the controlling unit controls the robotic arm to move along the moving track and to pick up one of the filling nozzles to fill the container with liquid through the opening.

The present inventive subject matter further provides a method of filling liquid, including the following steps. Step S1: the container is put into the filling zone of the machine assembly, wherein the filling zone of the machine assembly comprises the plurality of filling nozzles. Step S2: the controlling unit controls the robotic arm of the gripping unit to move along a moving track and to pick up one of the plurality of filling nozzles to fill the container with liquid through the opening of the container.

With such design, the machine assembly of the automatic liquid filling system could fill the container automatically with liquid. After the at least one of the containers is put in the filling zone of the machine assembly, the controlling unit controls the gripping unit to pick up one of the filling nozzles to fill the container with liquid. The automatic system and method of filling liquid could not only reduce labor cost, but also enhance the efficiency of operation.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
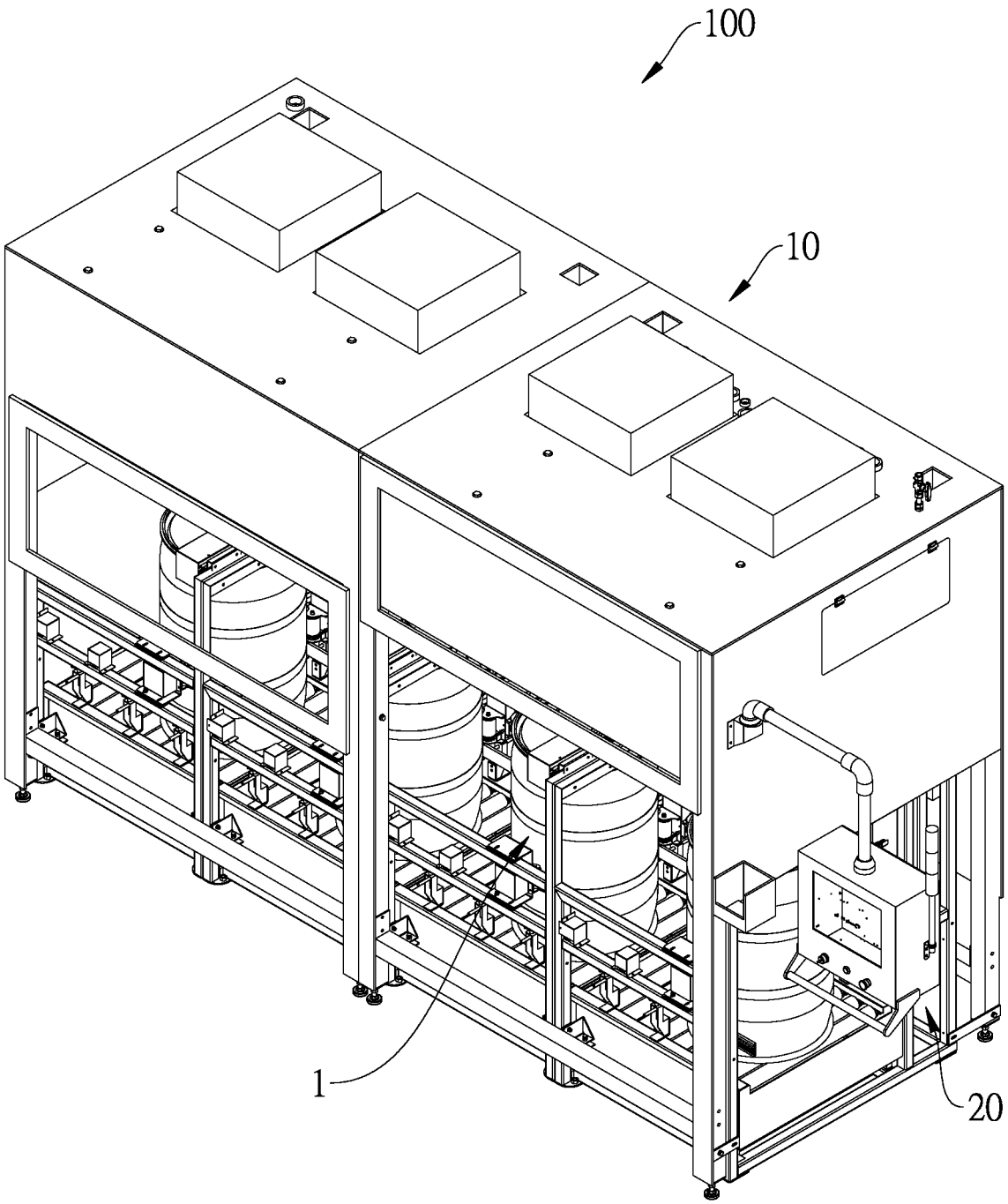
FIG. 1 is a perspective view of the automatic medical liquid filling system of a first embodiment according to the present invention.
Figure 2:
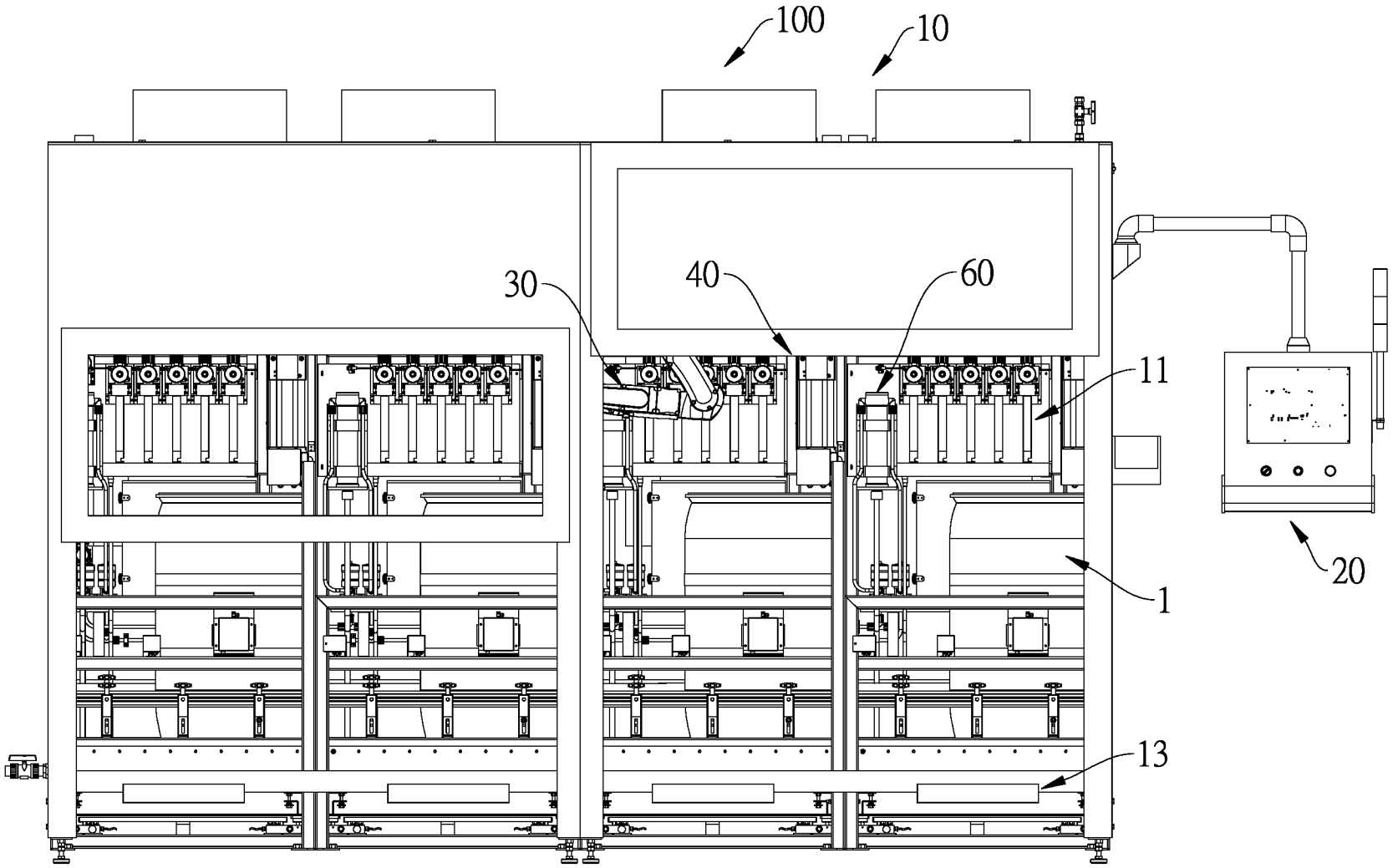
FIG. 2 is a front view of the automatic medical liquid filling system of the first embodiment according to the present invention.
Figure 3:
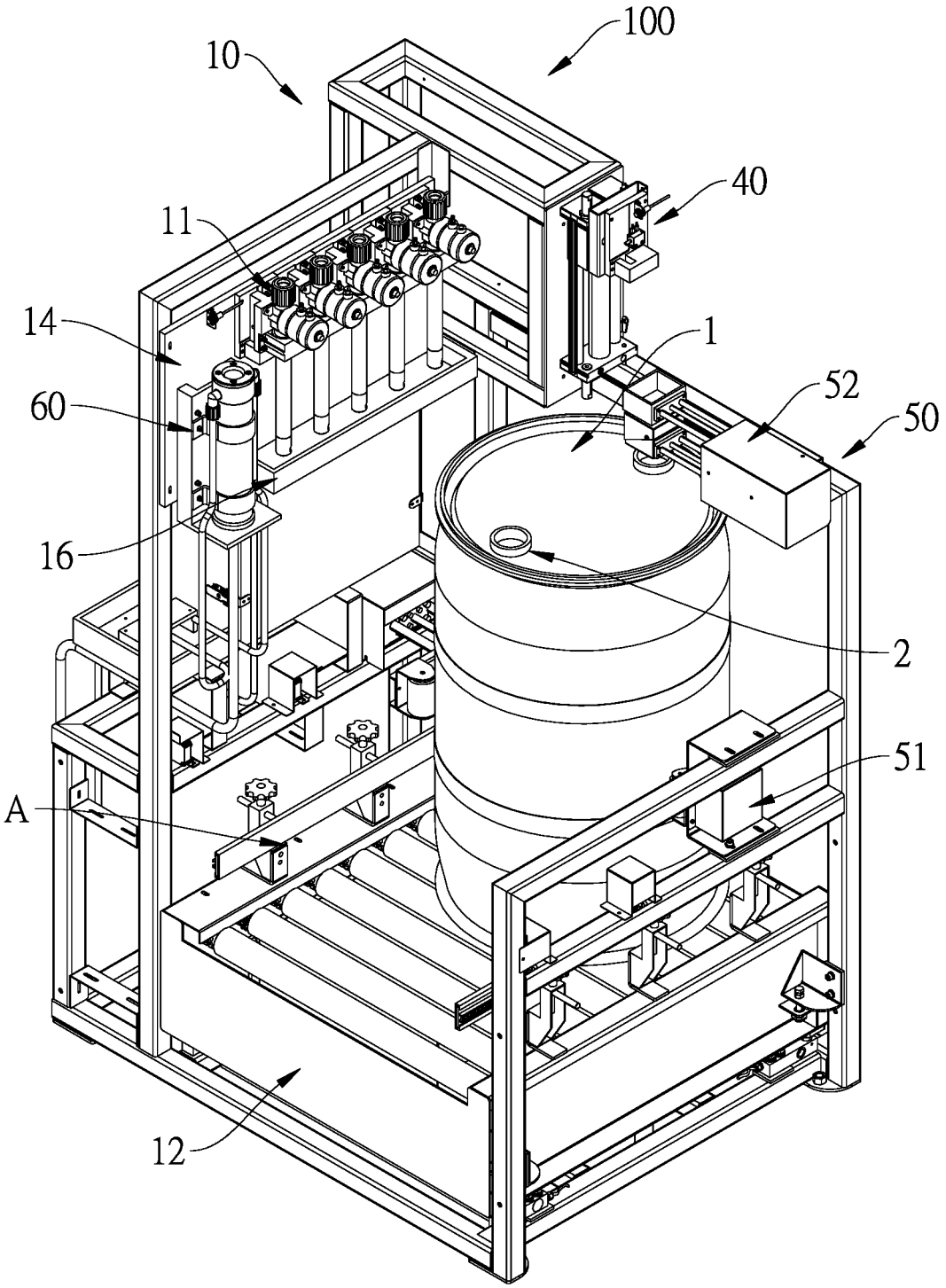
FIG. 3 is a partially schematic view of the machine assembly in FIG. 2.

As illustrated in FIG. 1 to FIG. 3, an automatic liquid filling system 100 of a first embodiment according to the present invention includes a machine assembly 10, wherein the machine assembly 10 is disposed with a controlling unit 20, a gripping unit 30, a lifting unit 40, an aligning unit 50, and a cleansing unit 60. In the current embodiment, the automatic liquid filling system 100 is adapted to fill vessels with liquid. The liquid mentioned in the present invention includes, but is not limited to, the chemical agent, medical solution, and so on.

As illustrated in FIG. 1 to FIG. 3, the machine assembly 10 has a filling zone A, wherein at least one container 1 for containing liquid is disposed in the filling zone A. The container 1 has two openings 2, wherein one of the two openings 2 is an inlet for injecting liquid in, and the other one of the two openings 2 is a vent. In other embodiment, the container 1 could have merely one opening as the inlet. The machine assembly 10 includes a plurality of filling nozzles 11 for outputting liquid, wherein the filling nozzles 11 are located in the filling zone A, and each of the filling nozzles 11 is connected to a liquid storage tank (not shown) via an infeed tube. In other embodiments, a number of the storage tank is more than one, and the storage tanks contain different kinds of liquid, respectively. Each of the storage tanks is connected to a part of the filing nozzles 11 via an infeed tube. The liquid in the liquid storage tank could be transmitted to the filling nozzles 11. In the first embodiment, the machine assembly 10 includes a conveyor seat 12 and a weight sensor 13. The conveyor seat 12 is located in the filling zone A, and a bottom portion of the conveyor seat 12 is disposed with a drive motor (not shown). The conveyor seat 12 drives the container 1 to move into the filling zone A. The weight sensor 13 is located beneath the conveyor seat 12 for measuring a weight of the container 1 and determining a degree of filling for liquid in the container 1.

Figure 4:
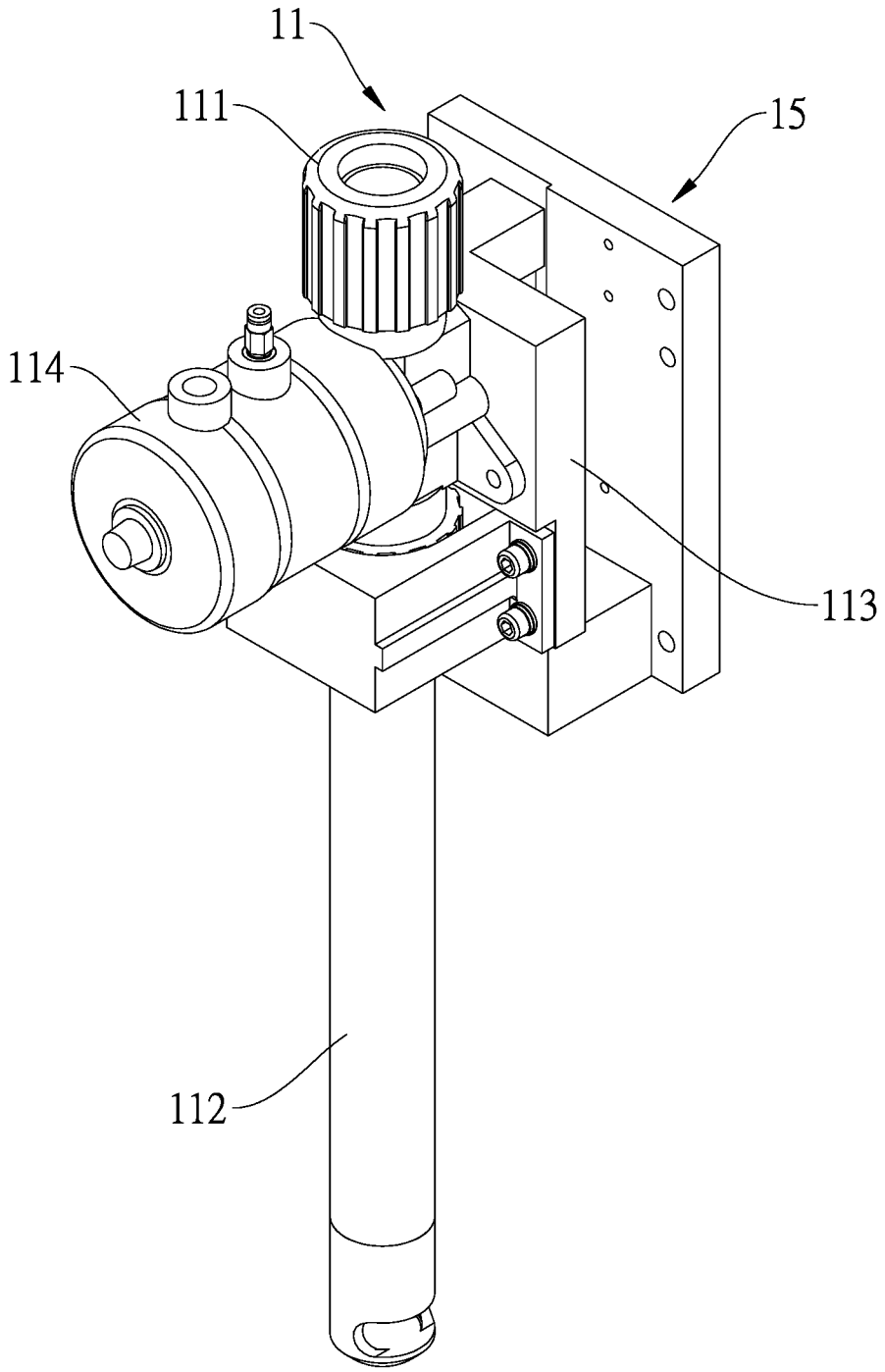
FIG. 4 is a perspective view of the filling nozzles and the mounting seat of the first embodiment according to the present invention.
Figure 5:
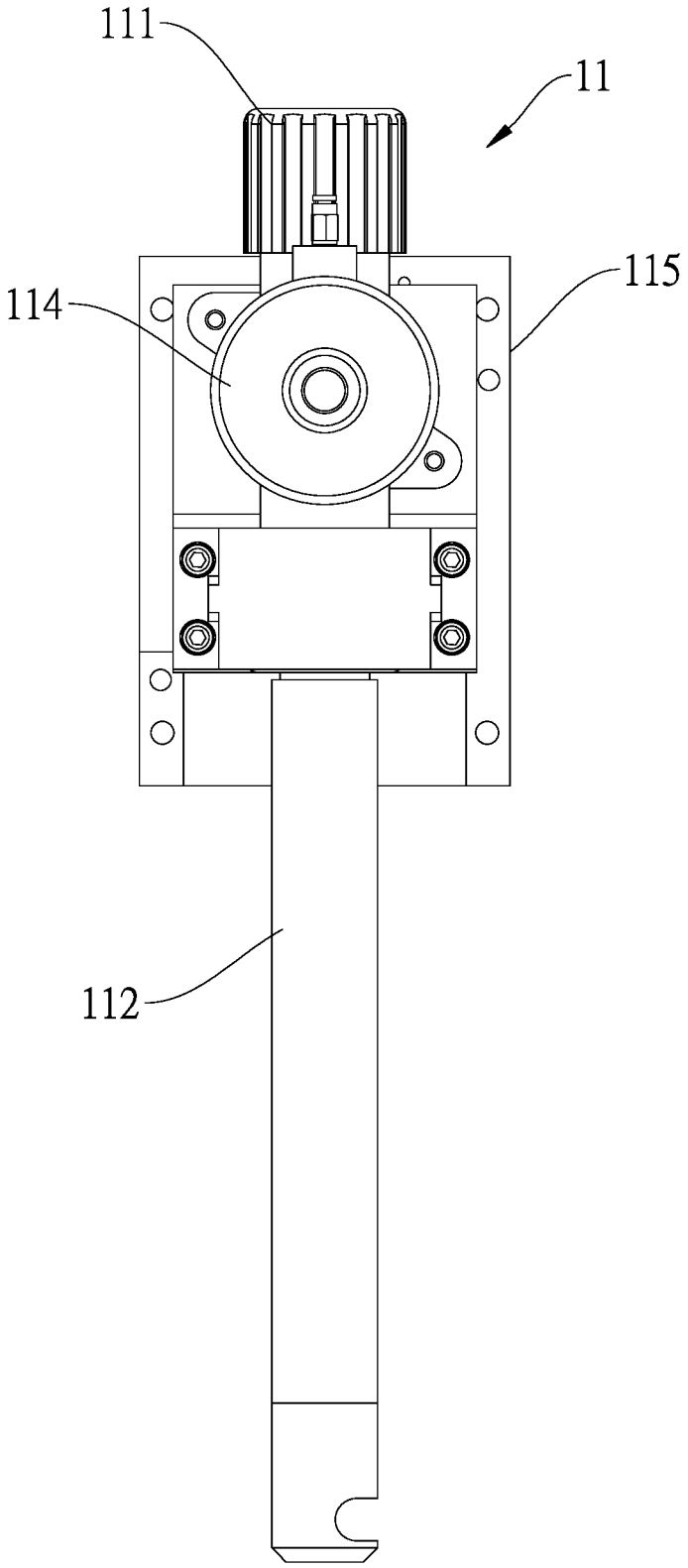
FIG. 5 is a front view of the filling nozzles and the mounting seat of the first embodiment according to the present invention.
Figure 6:
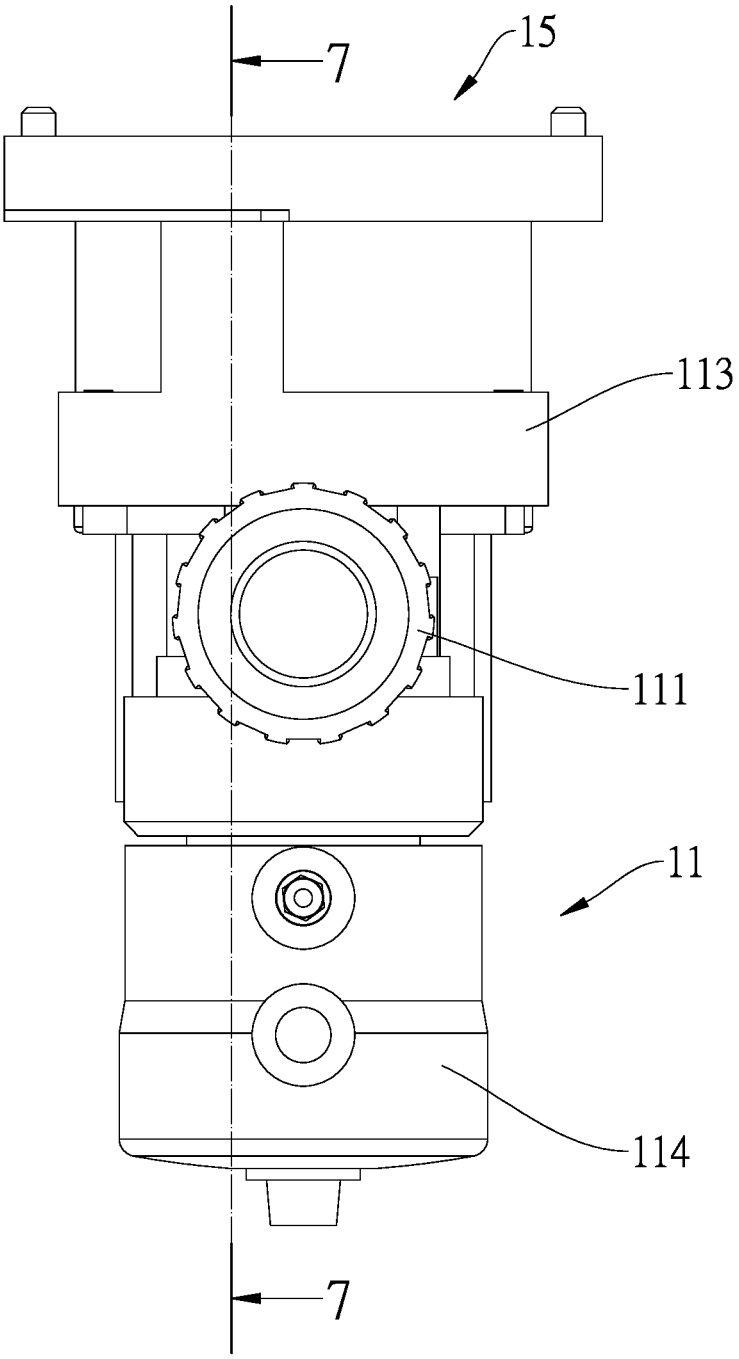
FIG. 6 is a top view of the filling nozzles and the mounting seat of the first embodiment according to the present invention.
Figure 7:
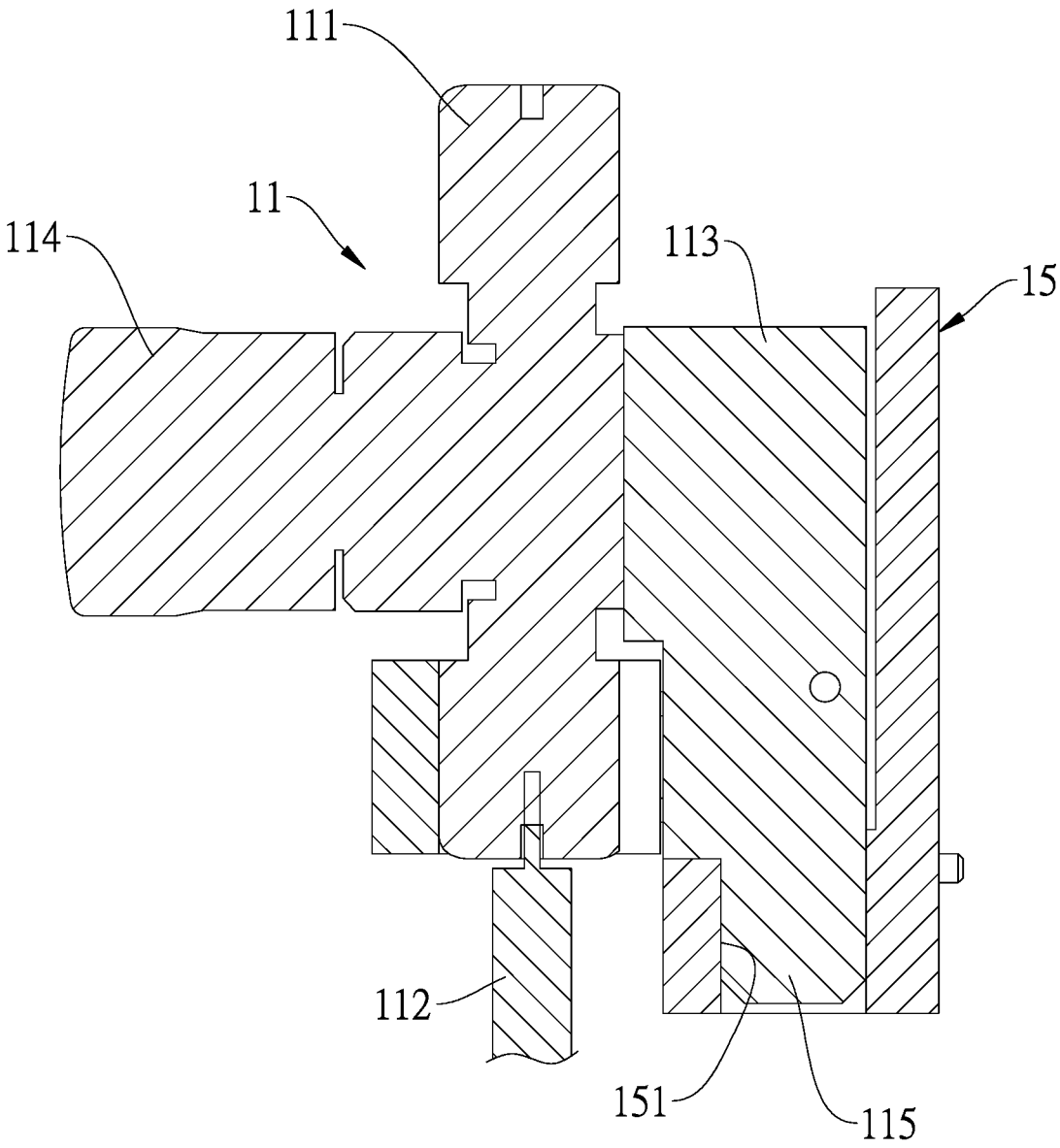
FIG. 7 is a section view taken along the 7-7 line in FIG. 6.

As illustrated in FIG. 3 and FIG. 4, the machine assembly 10 has a fixing frame 14, wherein the fixing frame 14 is located in the filling zone A. A plurality of mounting seats 15 is arranged on an upper portion of the fixing frame 14. Each of the filling nozzles 11 is disposed on one of the mounting seats 15. More specifically, as illustrated in FIG. 4 to FIG. 7, each of the filling nozzles 11 includes a connector 111, a body portion 112, an abutting portion 113, and an engaging portion 114. The connector 111 is connected to the storage tank. The body portion 112 is located below the connector 111, and the abutting portion 113 is located at a side of the connector 111. As illustrated in FIG. 7, each of the mounting seats 15 has a mounting hole 151 that penetrates through the mounting seats 15. A positioning block 115 is disposed on the abutting portion 113. When the filling nozzles 11 is disposed on the mounting seat 15, the abutting portion 113 abuts against the mounting seat 15, and the positioning block 115 is correspondingly engaged with the mounting hole 151, thereby allowing the body portion 112 to be suspended from the mounting seat 15. The engaging portion 114 is a pneumatic valve, which extends in a radial direction of the connector 111. The engaging portion 114 is adapted to be connected to the gripping unit 30.

Additionally, as illustrated in FIG. 3 and FIG. 4, the fixing frame 14 is disposed with a drip tray 16, wherein the drip tray 16 is located below the mounting seats 15. When each of the filling nozzles 11 is disposed on one of the mounting seats 15, the body portion 112 of each of the filling nozzles 11 suspends above the drip tray 16. The drip tray 16 could collect liquid that is dripped down from the filling nozzles 11, so that liquid remained in the filling nozzles 11 is prevented from dripping onto the filling zone A of the machine assembly 10.

In other embodiments, the configuration of the machine assembly 10 could be adjusted on the required demand. For example, the conveyor seat 12 could be substituted with other known conveyors. The fixing frame 14, the mounting seat 15, and the drip tray 16 could be optionally omitted, as long as the filling nozzles 11 could be disposed in the filling zone A of the machine assembly 10

The controlling unit 20 is a data processor, wherein the controlling unit 20 is electrically connected to and is adapted to control the gripping unit 30, the lifting unit 40, the aligning unit 50, and the cleansing unit 60. The controlling unit 20 could determine a level or a volume of liquid that is filled in the container 1 according to the weight change of the container 1, which is measured by the weight sensor 13. In other embodiments, the weight sensor 13 could be omitted, as long as the filling nozzles 11 could fill the container 1 with a certain or a desired amount of liquid.

The gripping unit 30 is located in the filling zone A and includes a moving track 31 and a robotic arm 32. The moving track 31 is connected to a top portion of the machine assembly 10. The robotic arm 32 is controlled to move along the moving track 31. When the container 1 is located in the filling zone A, the controlling unit 20 controls the robotic arm 32 to move along the moving track 31 and to pick up one of the filling nozzles 11 on the fixing frame 14, so that the filling nozzles 11 that is picked up could feed the container 1 with the liquid through one of the openings 2. In the current application, the gripping unit 30 picks the any one of the filling nozzles 11 by engaging the robotic arm 32 with the engaging portion 114 of the connector 111, so that the filling nozzle 11 that is engaged with the robotic arm 32 could be taken down from the fixing frame 14 as the robotic arm 32 is moved.

Figure 8:
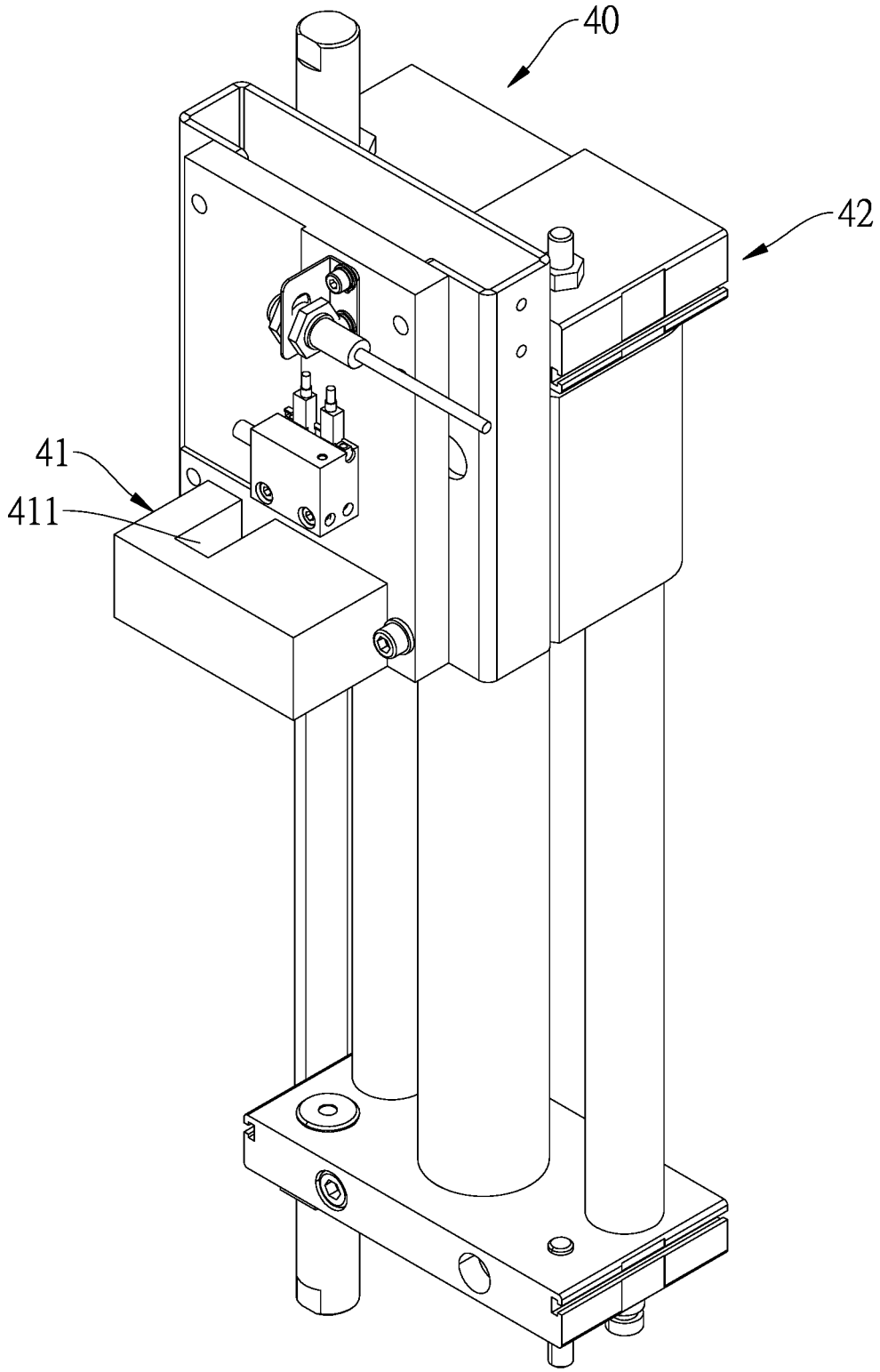
FIG. 8 is a perspective view of the lifting unit of the first embodiment according to the present invention.
Figure 9:
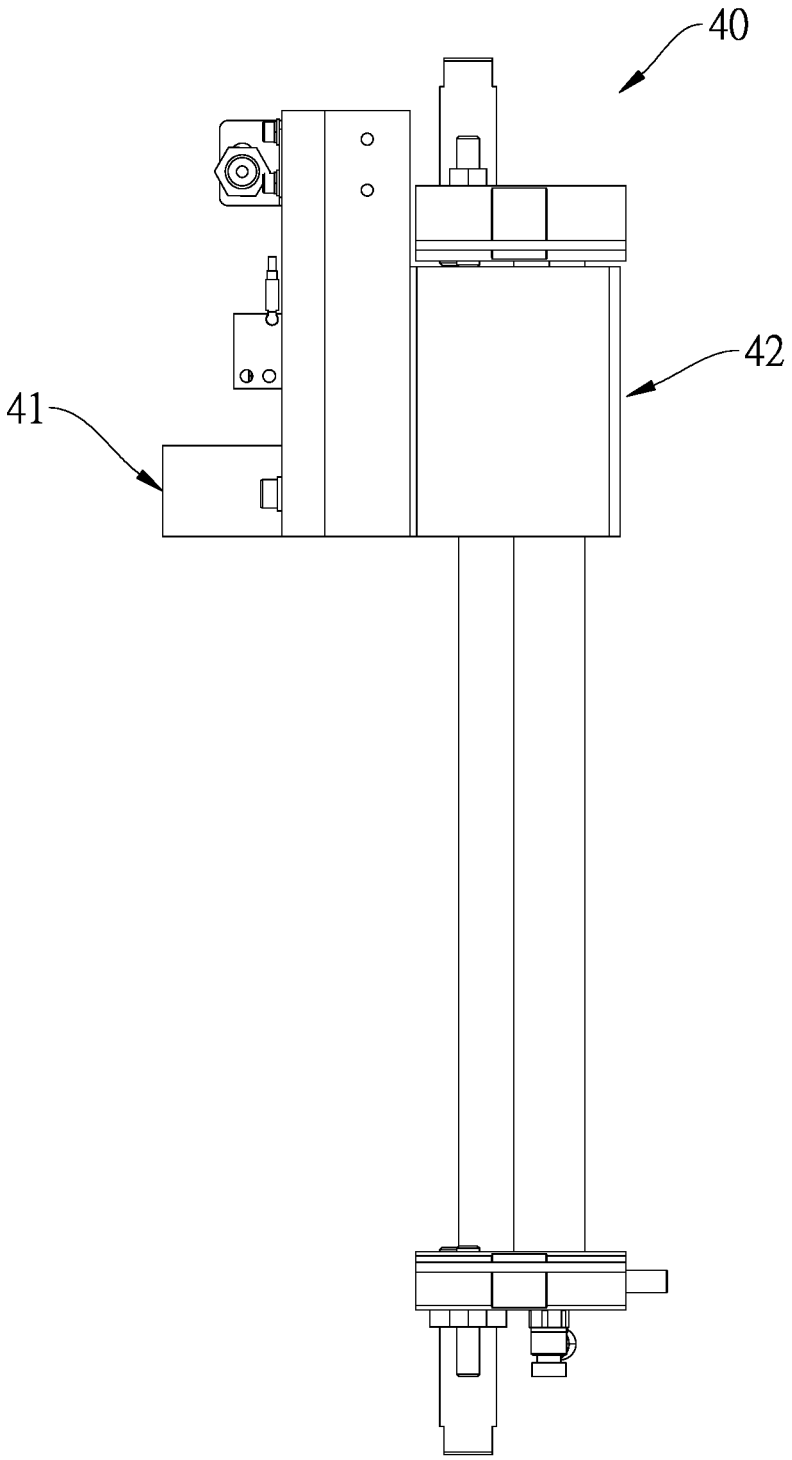
FIG. 9 is a side view of the lifting unit of the first embodiment according to the present invention.
Figure 10:
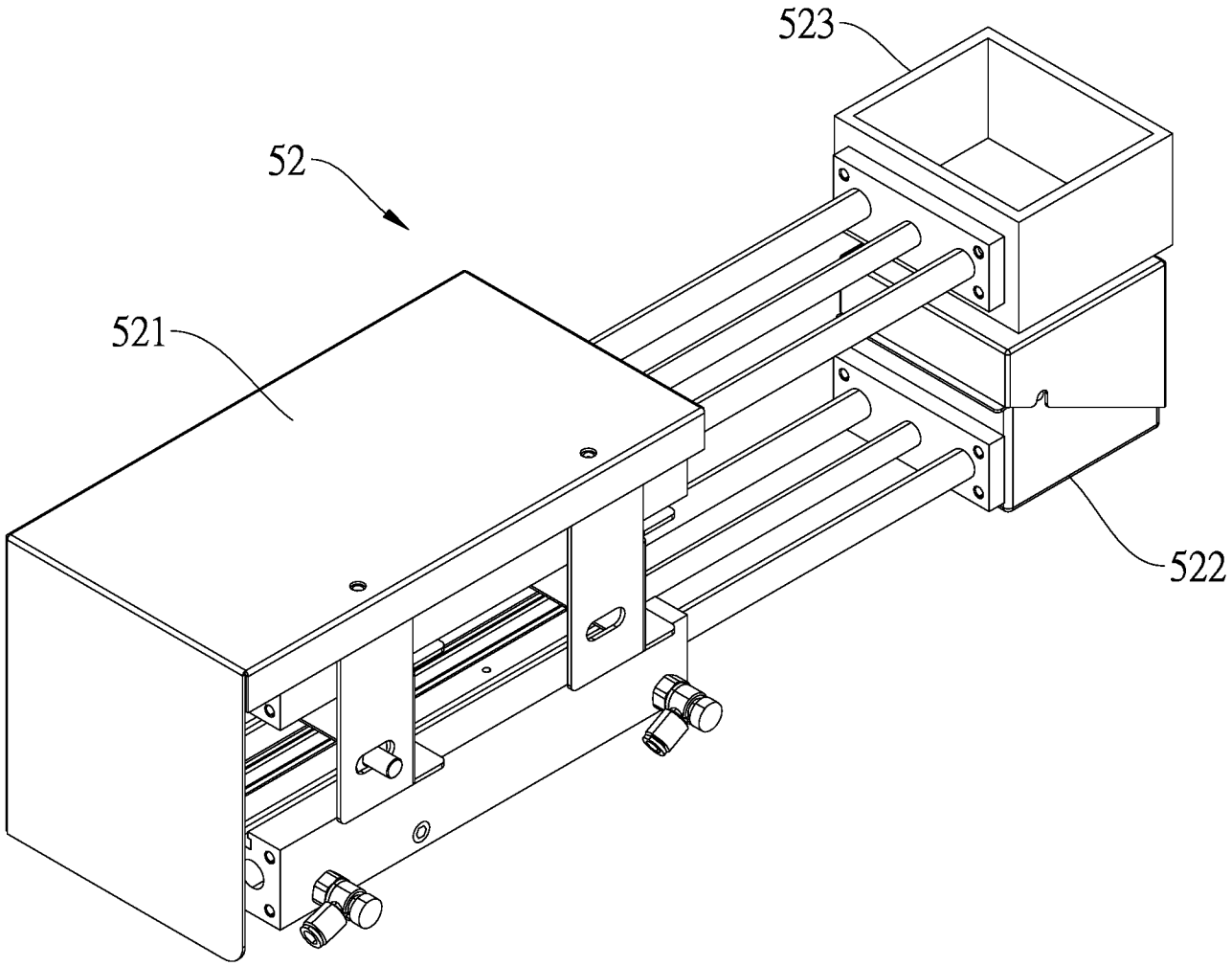
FIG. 10 is a perspective view of the sensor module of the first embodiment according to the present invention.

The lifting unit 40 is located in the filling zone A of the machine assembly and is adapted to receive the filling nozzle 11 which is taken down by the gripping unit The lifting unit 40 drives the filling nozzles 11 to move up and down. As illustrated in FIG. 8 and FIG. 9, the lifting unit 40 includes a positioning seat 41 and a lifting seat 42. The positioning seat 41 is provided for connecting to the filling nozzle 11. The positioning seat 41 has a positioning hole 411 that penetrated through the positioning seat 41. The lifting seat 42 is connected to a pneumatic cylinder to drive the positioning seat 41 to move up and down. In the current embodiment, the gripping unit 30 picks up one of the filling nozzles 11 from the fixing frame 14 and then mounts said filling nozzle 11 to the positioning seat 41. When said filling nozzle 11 is properly put on the positioning seat 41, the abutting portion 113 of said filling nozzle 11 abuts against the positioning seat 41, and the positioning block 115 of said filling nozzle 11 is engaged with the positioning hole 411 to position, thereby allowing the body portion 112 of said filling nozzle 11 is hung down from the positioning seat 41. After that, the lifting seat 42 drives the filling nozzle 11 on the positioning seat 41 to move toward the container 1 and to insert through one of the openings 2 the container 1 to fill the container 1 with liquid. When the controlling unit 20 determines that the container 1 is filled properly, the controlling unit 20 controls said filling nozzle 11 to stop outputting liquid and controls the lifting unit 40 to move the filling nozzle 11 away from the container 1, thereby allowing said filling nozzle 11 to exit through the one of two openings 2 of the container 1. In the current embodiment, when the container 1 is filled properly, the liquid level of the container 1 or the weight of the container 1 reaches a predetermined value that is set by an operator. The standard of "filled properly" could be adjusted based on the general knowledge in the art on required demand.

The aligning unit 50 is disposed in the filling zone A of the machine assembly 10 and is located below the lifting unit 40. The aligning unit 50 is adapted to position the container 1 and to sense a position of the openings 2 of the container 1. As illustrated in FIG. 10 to FIG. 13, the aligning unit 50 includes a clamping module 51 and a sensor module 52 for sensing the position of the openings 2 of the container 1. The clamping module 51 includes a fixed arm 511 and a telescopic arm 512, wherein the fixed arm 511 is disposed opposite to the telescopic arm 512, and the fixed arm 511 and the telescopic arm 512 are located at two sides of the conveyor seat 12, respectively. The telescopic arm 512 could move in a horizontal direction relative to the fixed arm 511 to abut against or detach from the container 1. When the container 1 is located in the filling zone A, the telescopic arm 512 could move toward the container 1 to make the container 1 be clamped between the telescopic arm 512 and the fixed arm 511. Additionally, as illustrated in FIG. 13, in the current embodiment, the fixed arm 511 is disposed with a pair of fixed rollers 513, and the telescopic arm 512 is disposed with a pair of transmitting rollers 514. The transmitting rollers 514 is connected to a driving motor 515. When the container 1 is clamped between the telescopic arm 512 and the fixed arm 511, circumferences of the fixed rollers 513 and circumference of the transmitting rollers 514 contact with a circumference of the container 1. The transmitting rollers 514 is controlled and driven by the driving motor 515 to rotate, thereby driving the container 1 to rotate. A number of the fixed rollers 513 and the transmitting rollers 514 is not limited to two, may also be three or more.

Figure 11:
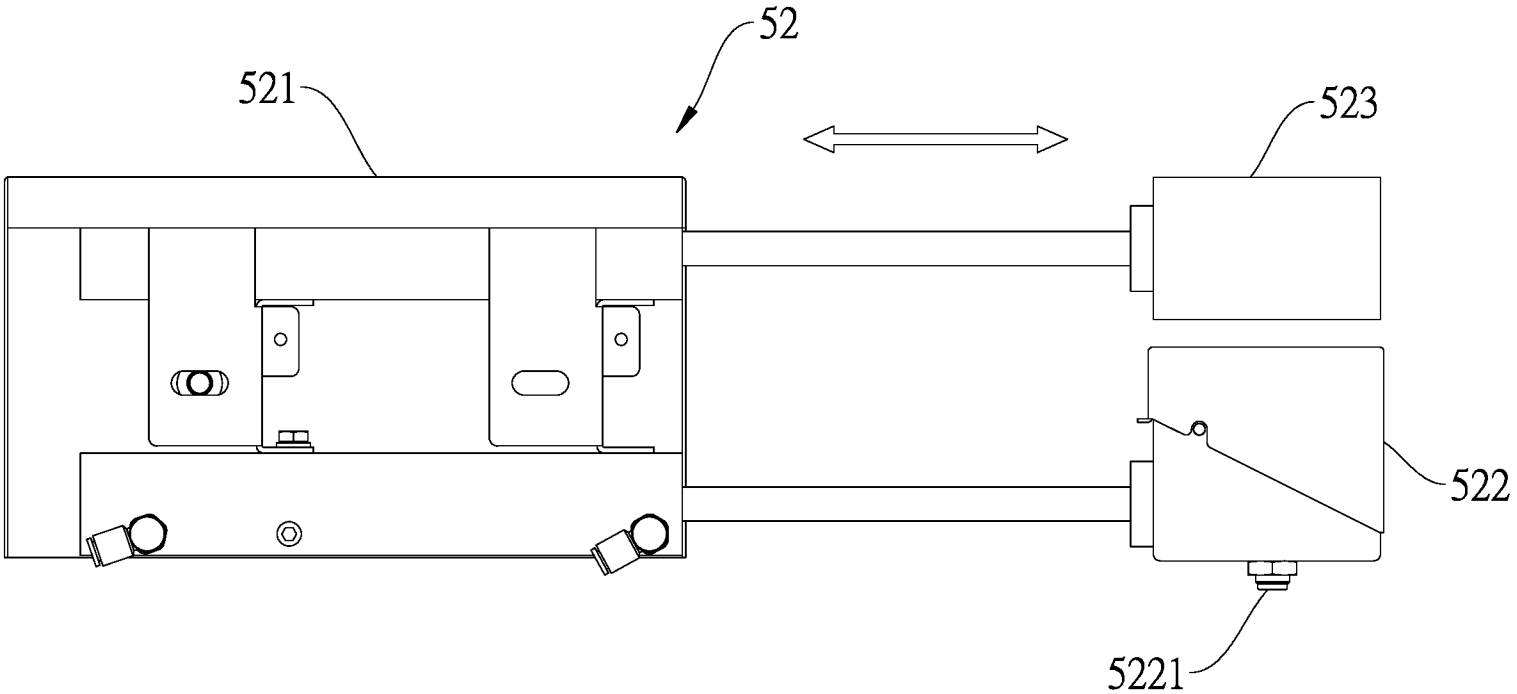
FIG. 11 is a side view of the sensor module of the first embodiment according to the present invention.
Figure 12:
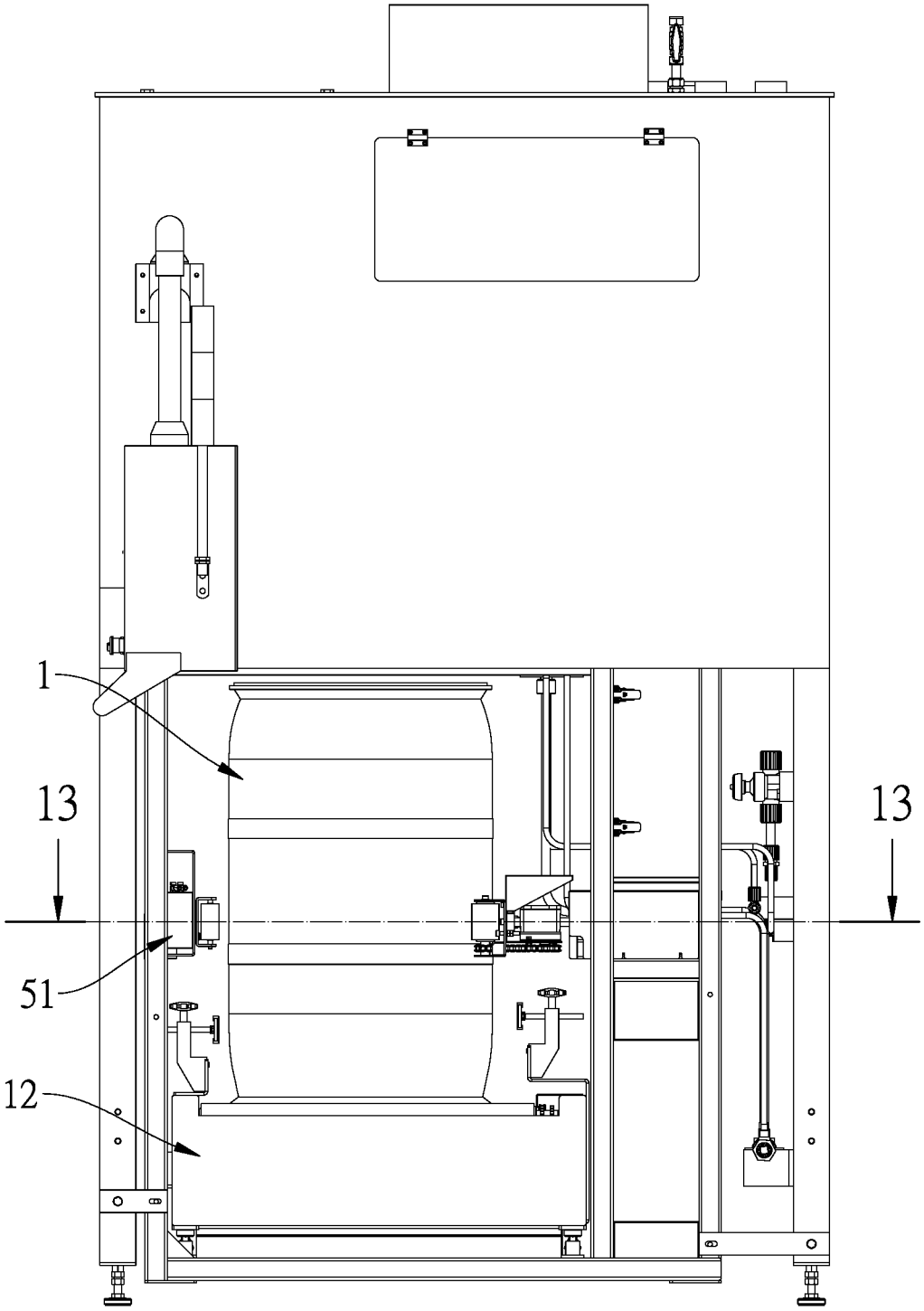
FIG. 12 is a side view of the automatic medical liquid filling system of the first embodiment according to the present invention.
Figure 13:
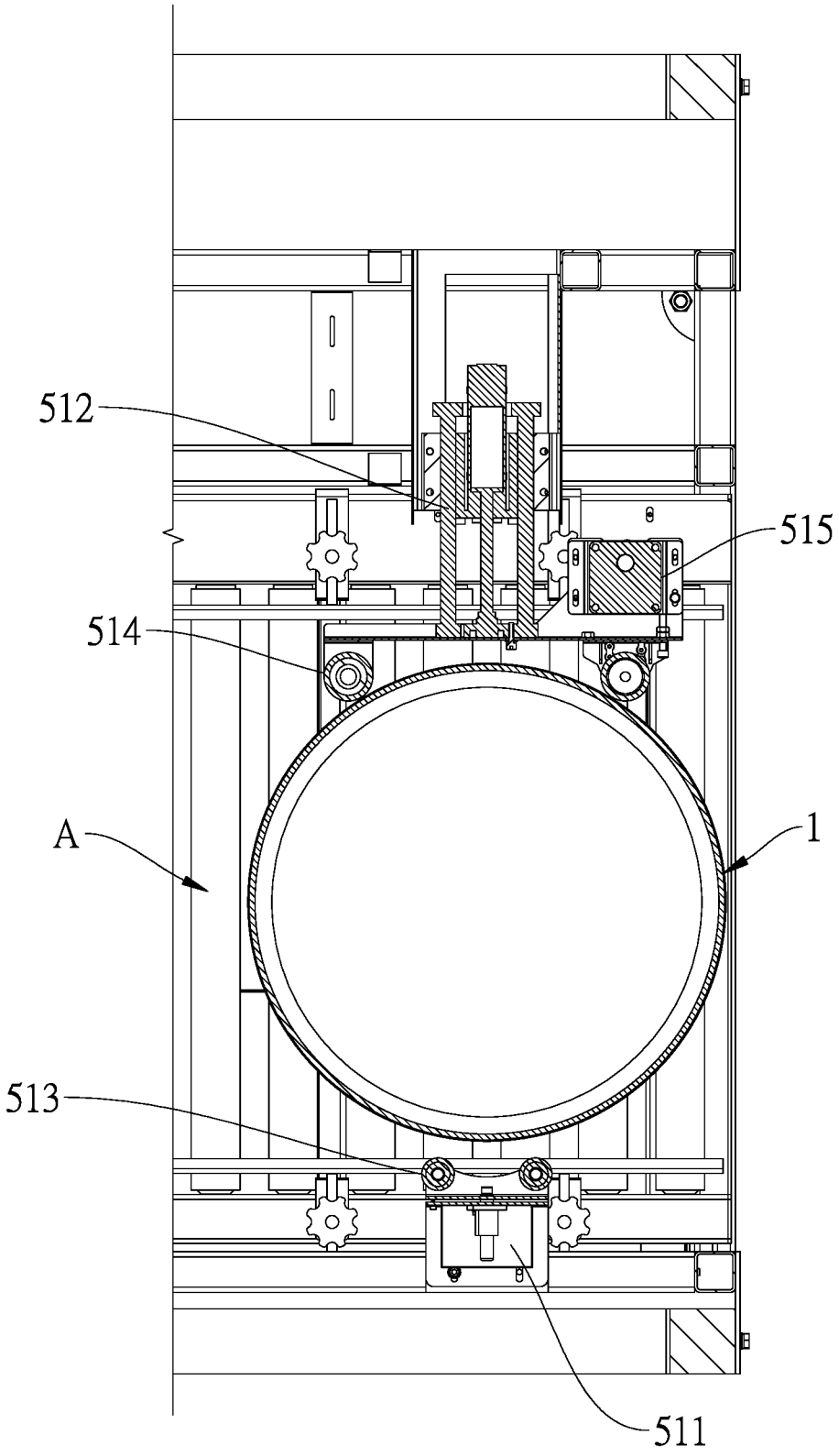
FIG. 13 is a section view taken along the 13-13 line in FIG. 12.

As illustrated in FIG. 11 and FIG. 12, the sensor module 52 is located above the clamping module 51, wherein the sensor module 52 includes a controller 521, a sensor 522, and a drip pan 523. The controller 521 is connected to the sensor 522 and the drip pan 523, respectively, so that the controller 521 could drive the sensor 522 and the drip pan 523 to simultaneously extend away from the controller 521 or retract back to the controller 521. The sensor 522 has a sensing portion 5221, which enables to emit and receive a sensing signal and is adapted to sense the position of the openings 2 of the container 1. The drip pan 523 is located above the sensor 522, which is adapted to collect the liquid dripped from the filling nozzle 11 mounted on the lifting unit 40.

More specifically, when the sensor module 52 senses the position of the opening 2, the controller 521 drives the sensor 522 and the drip pan 523 to extend away from the controller 521 in a direction toward the lifting unit 40. A sensing portion 5221 of the sensor 522 faces the container 1. At this time, the gripping unit 30 picks up one of the filling nozzles 11 on the fixing frame 14 and mounts the filling nozzle 11 that is picked up to the lifting unit 40. The filling nozzle 11 that is mounted to the lifting unit 40 is suspended above the drip pan 523, so that the drip pan 523 prevents the residue in the filling nozzle 11 from dripping to the sensor 522. After the sensor 522 senses the openings 2 of the container 1, the controller 521 drives the sensor 522 and the drip pan 523 to return in a direction toward the controller 521, and the lifting unit 40 drives the filling nozzle 11 to descend in a direction toward the container 1, thereby allowing the filling nozzle 11 to be inserted through one of the openings 2 of the container 1 to fill the container 1 with the liquid.

Figure 14:
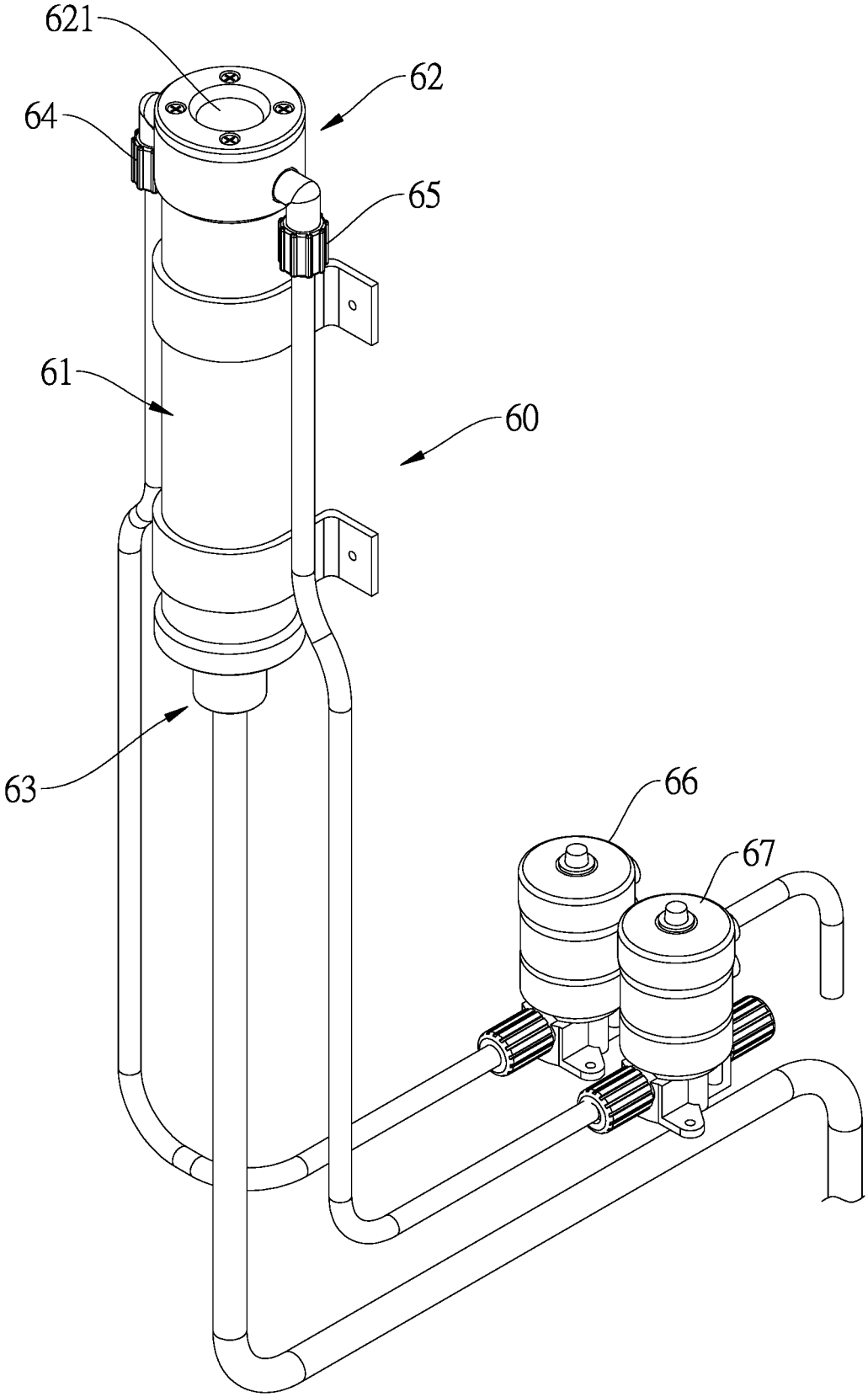
FIG. 14 is a perspective view of the cleansing unit of the first embodiment according to the present invention.
Figure 15:
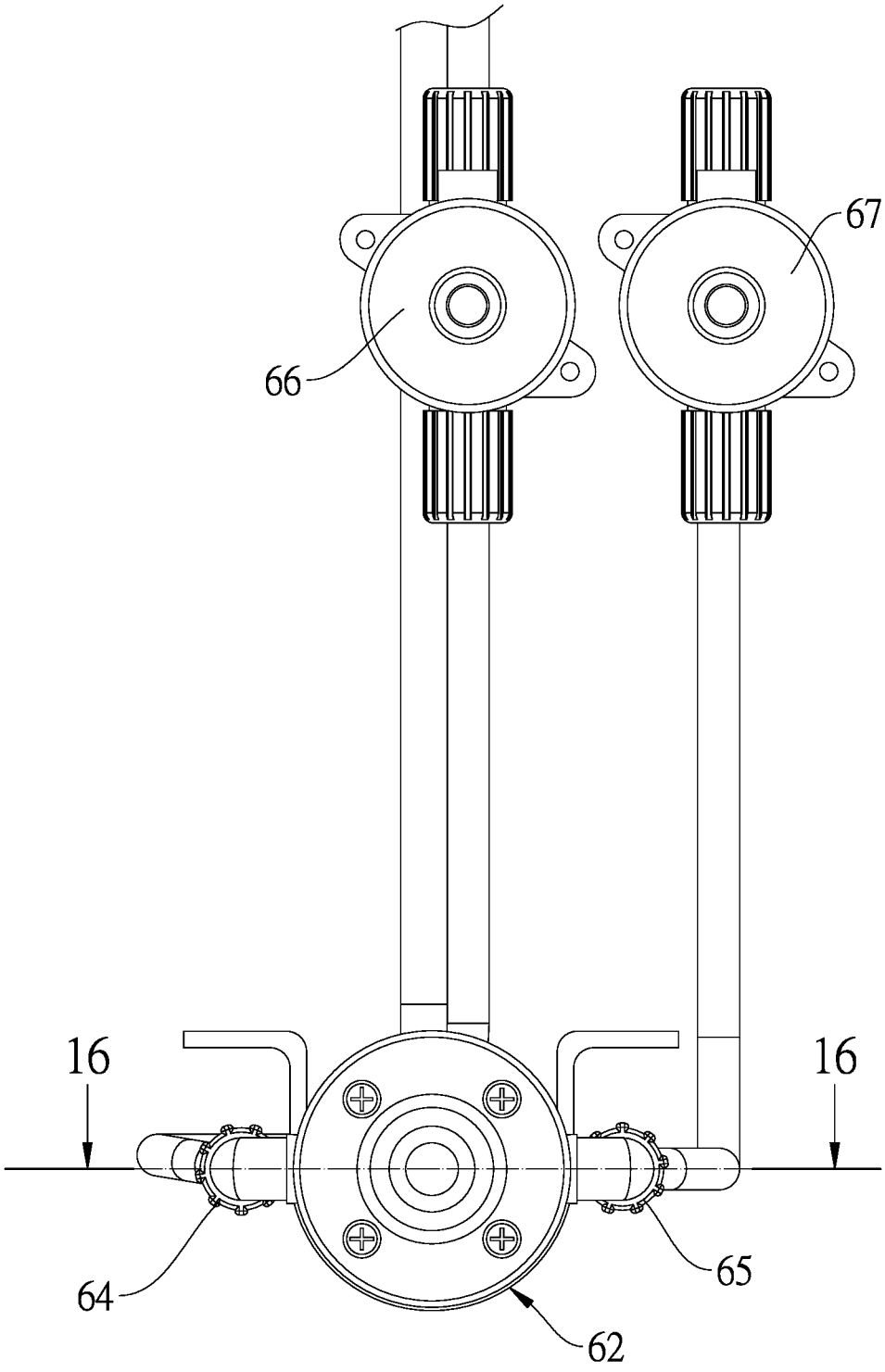
FIG. 15 is a top view of the cleansing unit of the first embodiment according to the present invention.
Figure 16:
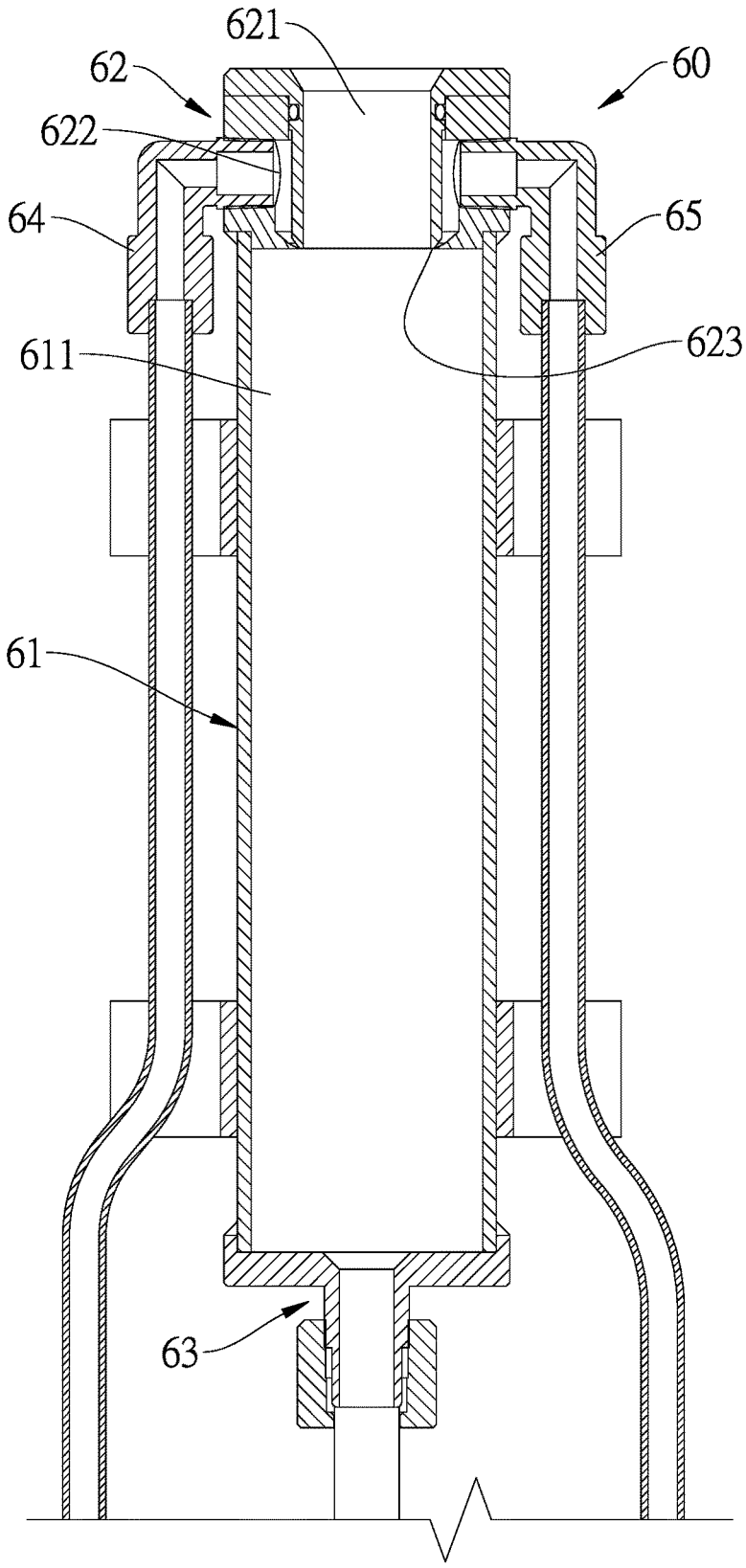
FIG. 16 is a section view taken along the 16-16 line in FIG. 15.

As illustrated in FIG. 3 and FIG. 14, the cleansing unit 60 is located in the filling zone A of the machine assembly 10 and is adapted to receive the filling nozzle 11 taken down from the lifting unit 40 and clean the body portion 112 of the filling nozzle 11. As illustrated in FIG. 14 to FIG. 16, the cleansing unit 60 includes a cylinder 61 and a connecting portion 62. The cylinder 61 is fixed on the fixing frame 14 and has a cleaning space 611 inside. The cylinder 61 is not limited to circular, but may be any shape. The connecting portion 62 has an axial hole 621 that communicates with the cleaning space 611 of the cylinder 61. The connecting portion 62 is provided for the body portion 112 of the filling nozzle 11 to be inserted into the cleaning space 611. The connecting portion 62 has a converging space 622 inside, wherein the converging space 622 does not directly communicate with the axial hole 621. The connecting portion 62 has an annular opening 623 at a side of the connecting portion 62 that faces the cylinder 61. The annular opening 623 surrounds the axial hole 621 and communicates with the cleaning space 611 and the converging space 622.

More specifically, the cleansing unit 60 includes an evacuating portion 63, a liquid inlet 64, and a gas inlet 65. The evacuating portion 63 is located at a bottom portion of the cylinder 61 and communicates with the cleaning space 611. The connecting portion 62 has the liquid inlet 64 and the gas inlet 65 on a circumference of the connecting portion 62, wherein each of the liquid inlet 64 and the gas inlet 65 communicates with the converging space 622. The liquid inlet 64 is connected to a first pneumatic valve 66 via a tube, and the gas inlet 65 is connected to a second pneumatic valve 67 via a tube. When the filling nozzle 11 is mounted in the cleansing unit 60, the cleansing unit 60 is controlled by the controlling unit 20 to activate the first pneumatic valve 66 to input cleaning liquid into the cleaning space 611 through the liquid inlet 64 to clean the body portion 112 of the filling nozzle 11. After the cleaning process for cleaning the body portion 112 of the filling nozzle 11 is finished, the evacuating portion 63 evacuates the cleaning liquid in the cleaning space 611 out. Then, the second pneumatic valve 67 is activated to input air into the cleaning space 611 through the gas inlet 65 to dry the body portion 112 of the filling nozzle 11. In the current embodiment, the evacuating portion 63 and the axial hole 621 are coaxial.

With such design, the machine assembly 10 of the automatic liquid filling system 100 of the first embodiment according to the present invention could automatically fill the container 1 with liquid. When the container 1 is put into the filling zone A of the machine assembly 10, the gripping unit 30 is controlled by the controlling unit 20 to automatically pick up one of the filling nozzles 11 and make the filling nozzle 11 that is picked up fill the container 1 with the liquid, thereby saving manpower. Additionally, the filling zone A of the machine assembly 10 could receive a plurality of the containers 1 and simultaneously fill the containers 1 automatically to enhance the efficiency of the automatic filling process.

Besides, after the container 1 enters into the filling zone A of the machine assembly 10, the aligning unit 50 positions the container 1 and drives the container 1 to rotate until the sensor 522 senses the openings 2 is aligned with the lifting unit 40, so that the filling nozzle 11 on the lifting unit 40 could be precisely inserted through one of the two openings 2 to fill the container 1.

Figure 17:
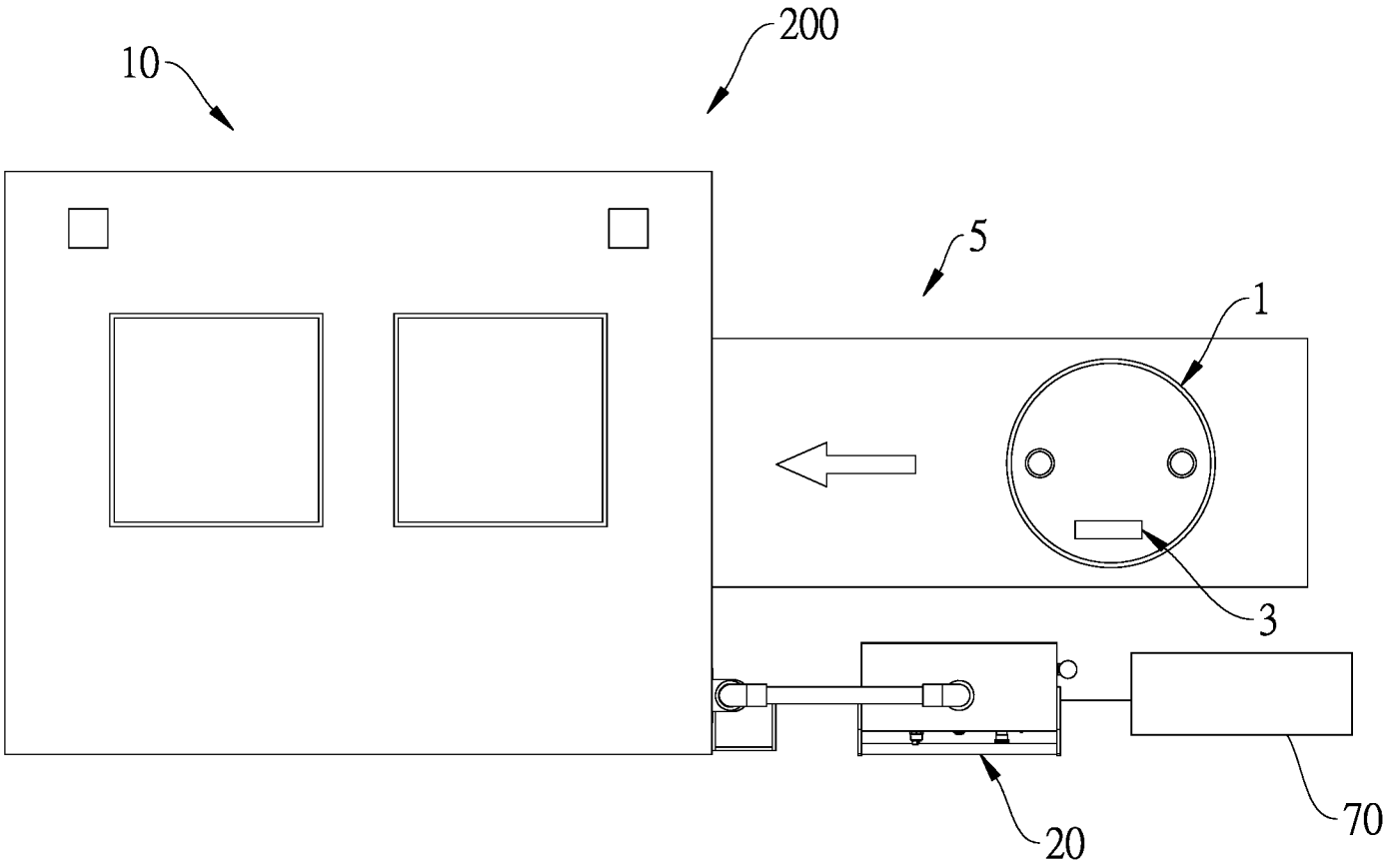
FIG. 17 is a schematic view of the automatic medical liquid filling system of a second embodiment according to the present invention.

As illustrated in FIG. 17, an automatic liquid filling system 200 of a second embodiment according to the present invention includes the machine assembly 10, the controlling unit 20, the gripping unit 30, the lifting unit 40, the aligning unit 50, and the cleansing unit 60 that are described in the first embodiment. The differences between the second embodiment and the first embodiment are described as follow. The machine assembly 10 has a buffering zone B that is connected to the filling zone A. The container 1 has a barcode 3 that stores a liquid filling information in advance. The buffering zone B is disposed with a barcode reader 70, wherein the barcode reader 70 is electrically connected to the controlling unit 20 and is adapted to read the barcode 3 on the container 1. When the container 1 is located in the buffering zone B, the barcode reader 70 read the barcode 3 on the container 1 to receive and display the liquid filling information stored in the barcode 3. After that, the barcode reader 70 transmits the liquid filling information that is received to the controller unit 20, so that the controlling unit 20 controls the gripping unit 30 to pick up the corresponding one of the filling nozzle 11 in accordance with the liquid filling information and to allow the filling nozzle 11 that is picked up to fill the container 1 with liquid.

Before the container 1 enters the filling zone A, the barcode reader 70 at the buffering zone B could identify the barcode 3 on the container 1, so that the controlling unit 20 could precisely control the gripping unit 30 to pick up proper one of the filling nozzles 11, thereby saving the manpower for identifying and classifying the container 1 and enhancing the accuracy of the automatic filling process.

Figure 18:
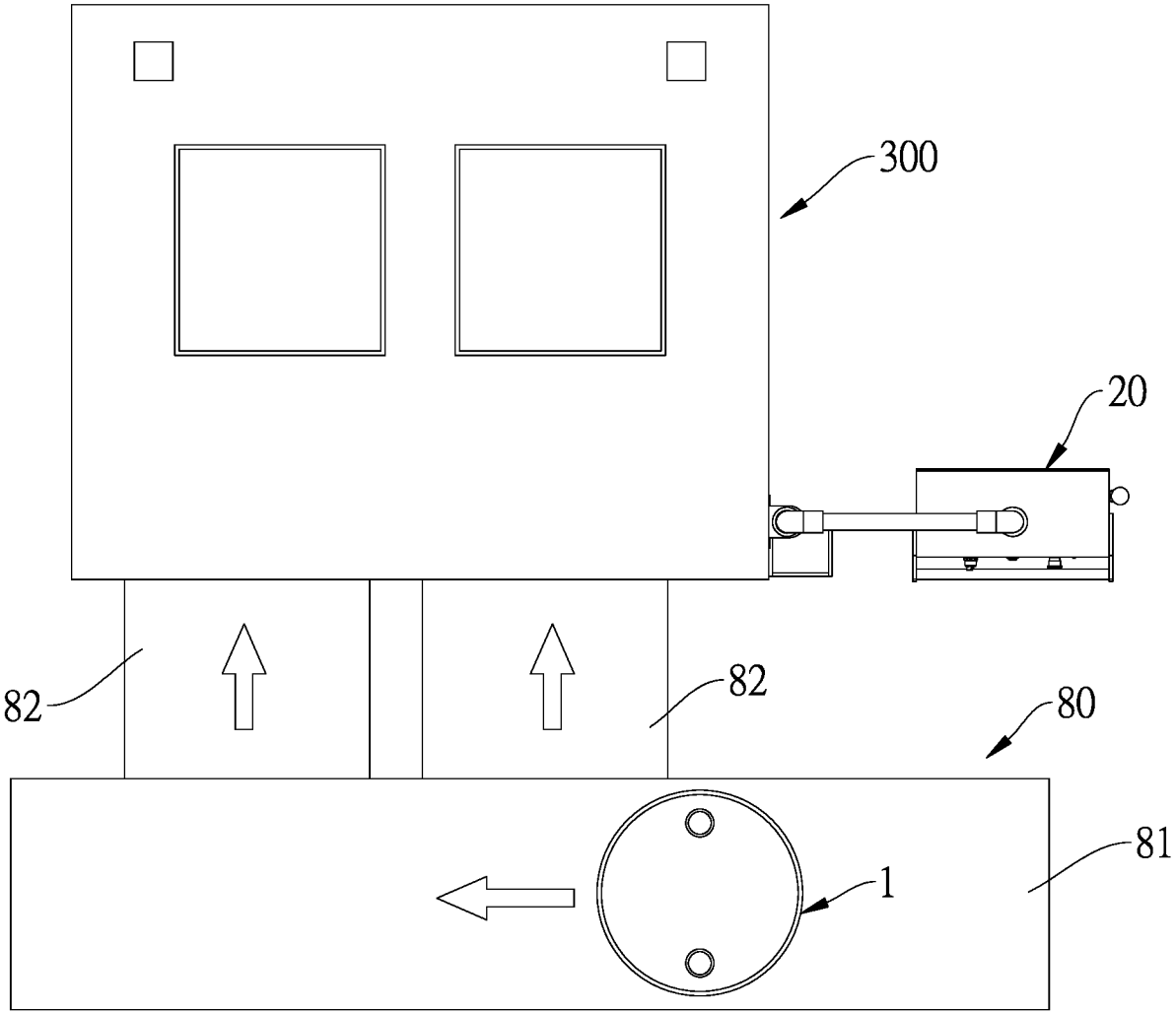
FIG. 18 is a schematic view of the automatic medical liquid filling system of a third embodiment according to the present invention.
Figure 19:
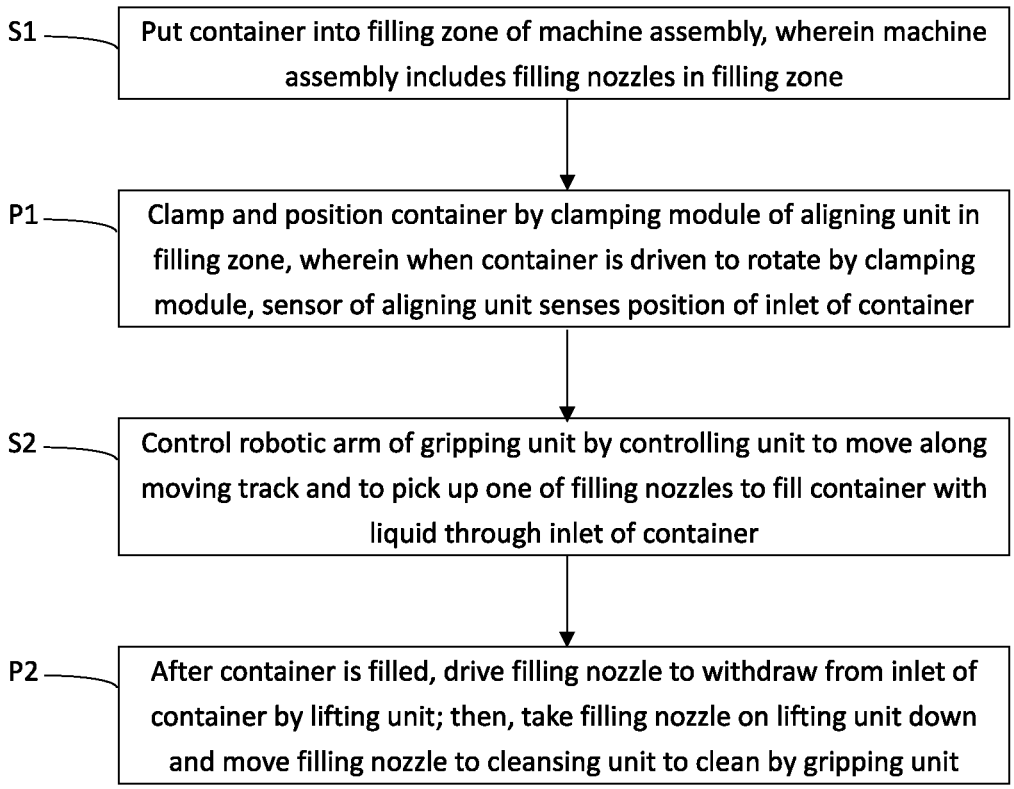
FIG. 19 is a flow chart of the method for filling the medical liquid filling automatically of an embodiment according to the present invention.

As illustrated in FIG. 18, an automatic liquid filling system 300 of a third embodiment according to the present invention includes the machine assembly 10, the controlling unit 20, the gripping unit 30, the lifting unit 40, the aligning unit 50, and the cleansing unit 60 that are described in the first embodiment. The differences between the second embodiment and the first embodiment are described as follow. The automatic liquid filling system 300 further includes a conveyor unit 80, wherein the conveyor unit 80 includes a conveying track 81 and a transferring track 82. A transporting direction of the conveying track 81 is different than a transporting direction of the transferring track 82. The conveying track 81 is located out of the machine assembly 10 and is adapted to convey the container 1. The transferring track 82 is connected between the conveying track 81 and the filling zone A of the machine assembly 10, wherein the transferring track 82 is adapted to receive the container 1 that is conveyed by the conveying track 81 and to convey the container 1 to the filling zone A of the machine assembly 10.

Figure 20:
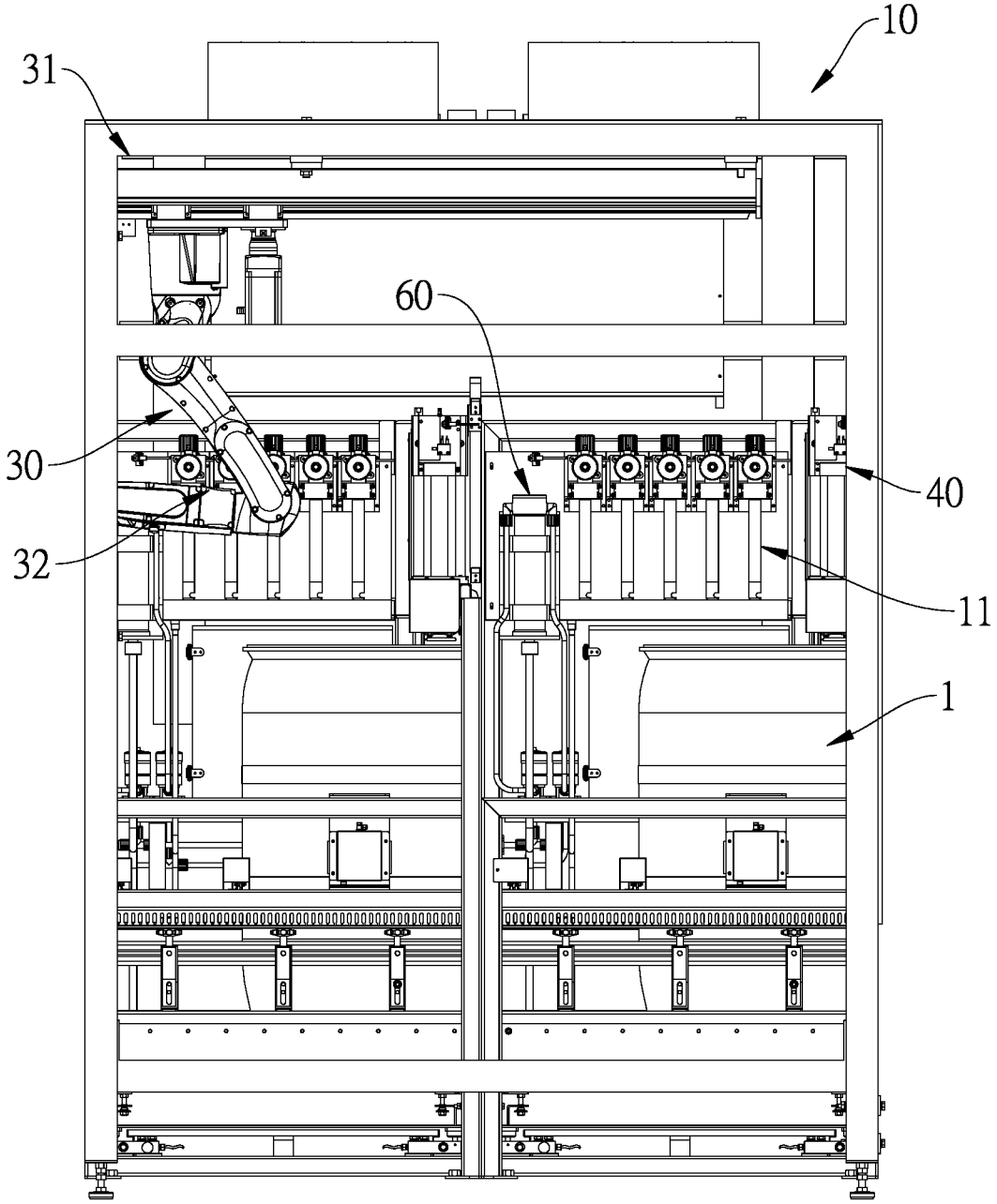
FIG. 20 is a schematic view showing the container is put into the filling zone A.
Figure 21:
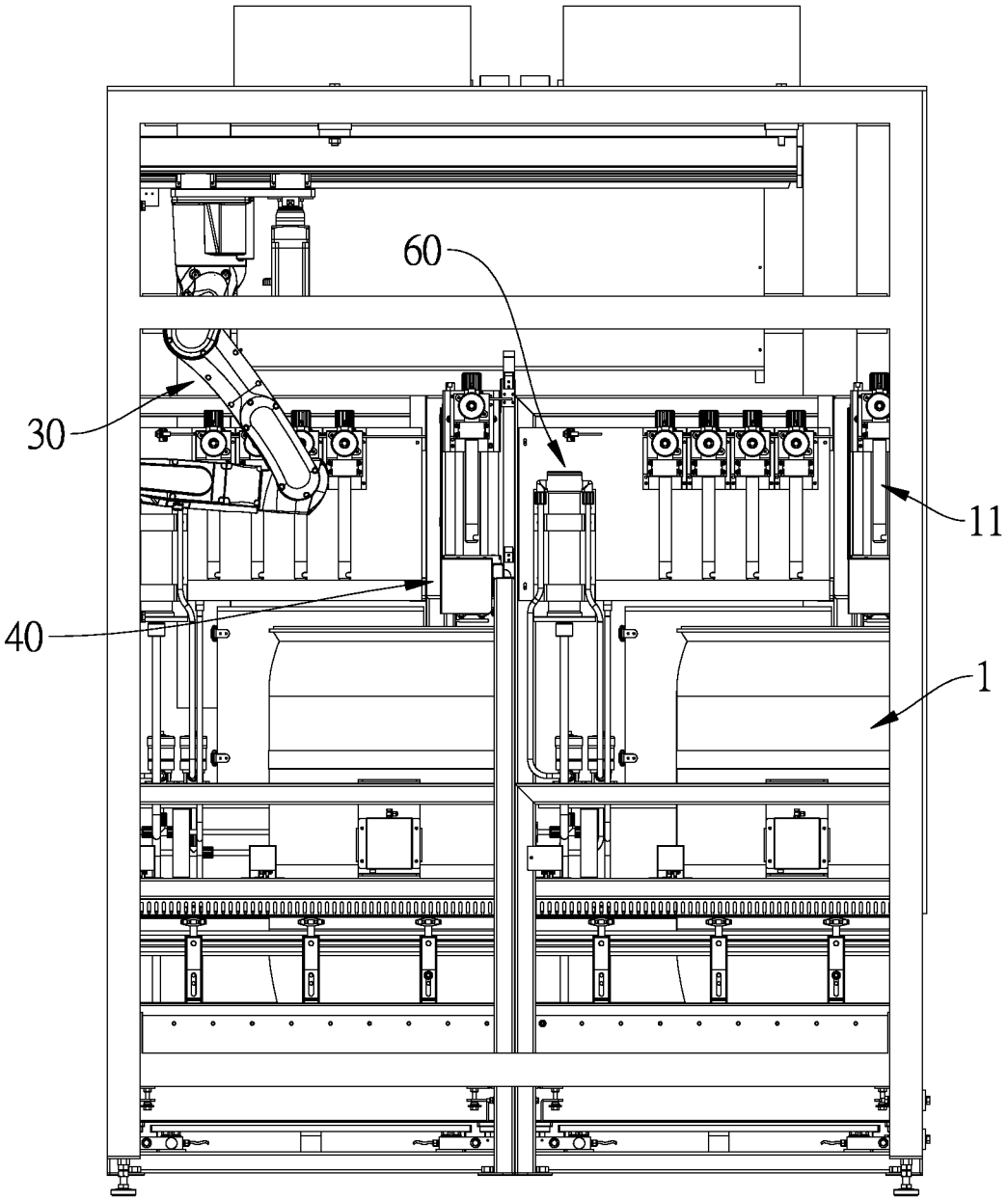
FIG. 21 is a schematic view showing one of the filing nozzles is mounted to the lifting unit.

A method of filling liquid which is conducted by the automatic liquid filling system 100 of the first embodiment according to the present invention is described below. As illustrated in FIG. 19 to FIG. 23, the method of filling liquid includes:

Step S1: As illustrated in FIG. 20, the container 1 is put into the filling zone A of the machine assembly 10, wherein the filling zone A of the machine assembly 10 is disposed with the plurality of filling nozzles 11.

Step P1: the container 1 is clamped by the clamping module 51 of the aligning unit 50 to position in the filling zone A. As illustrated in FIG. 11 to FIG. 13, when the container 1 is clamped between the fixed arm 511 and the telescopic arm 512, the controller 521 controls the sensor 522 to extend to a location that is above the container 1, and the sensing portion 5221 of the sensor 522 faces the container 1. At the time, the fixed rollers 513 and the transmitting rollers 514 contact with the circumference of the container 1, and the driving motor 515 controls the transmitting rollers 514 to spin to drive the container 1 to spin as well. During a process of spinning the container 1, the sensing portion 5221 of the sensor 522 senses the openings 2 of the container 1 above the container.

Figure 22:
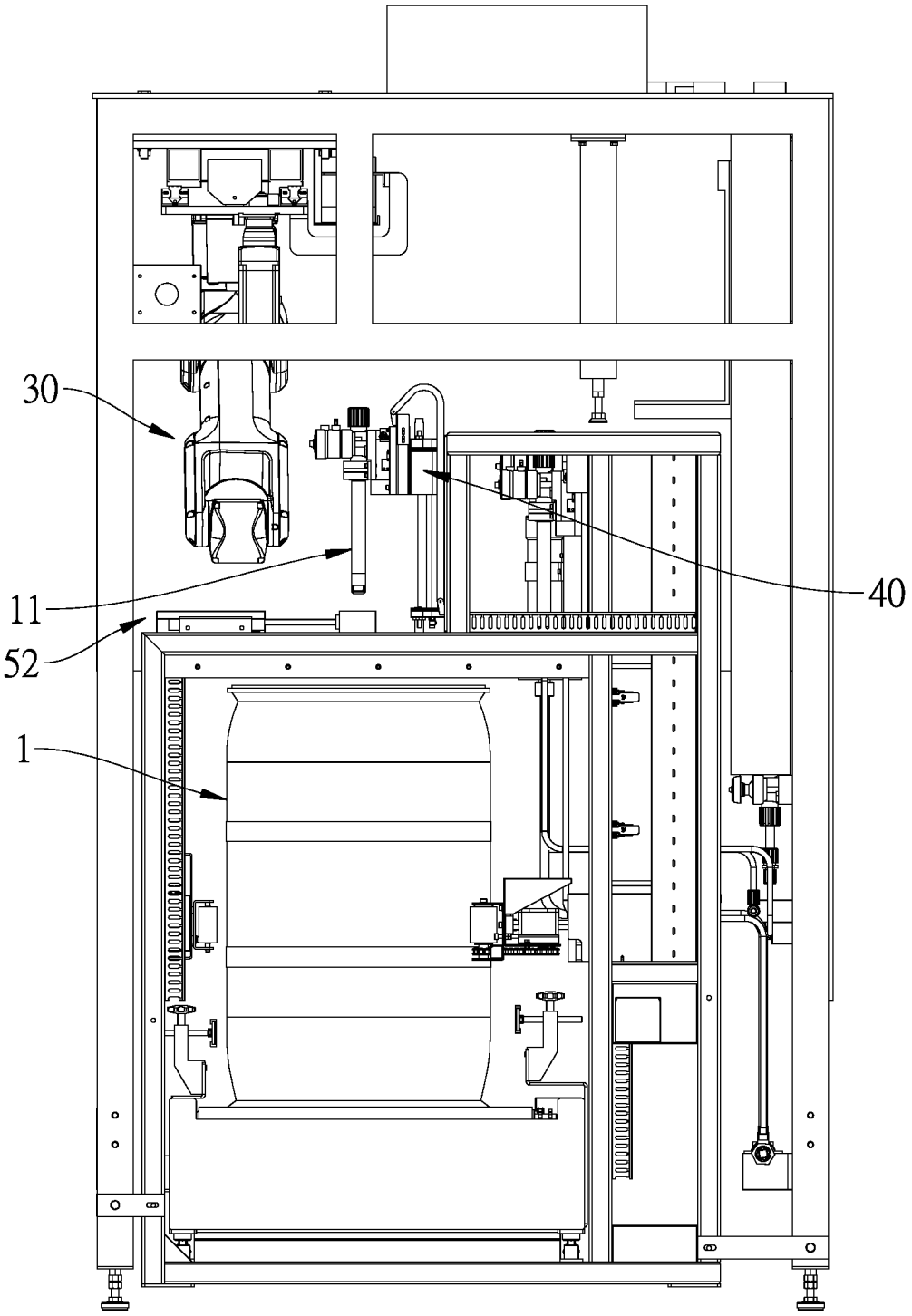
FIG. 22 is a side view of the automatic medical liquid filling system shown in FIG. 21; and, FIG. 23 is a schematic view showing the filling nozzle is put into the cleansing unit.

Step S2: The robotic arm 32 of the gripping unit 30 is controlled by the controlling unit 20. The robotic arm 32 is movable along the moving track 31 and is adapted to pick up one of the filling nozzles 11 in the filling zone A to fill the container 1 with the liquid through the openings 2 of the container 2. More specifically, as illustrated in FIG. 22, the gripping unit 30 picks up one of the filling nozzles 11 to mount with the lifting unit 40. The lifting unit 40 drives the filling nozzle 11 to insert through the openings 2 of the container 1 to fill the container 1 with liquid.

Figure 23:
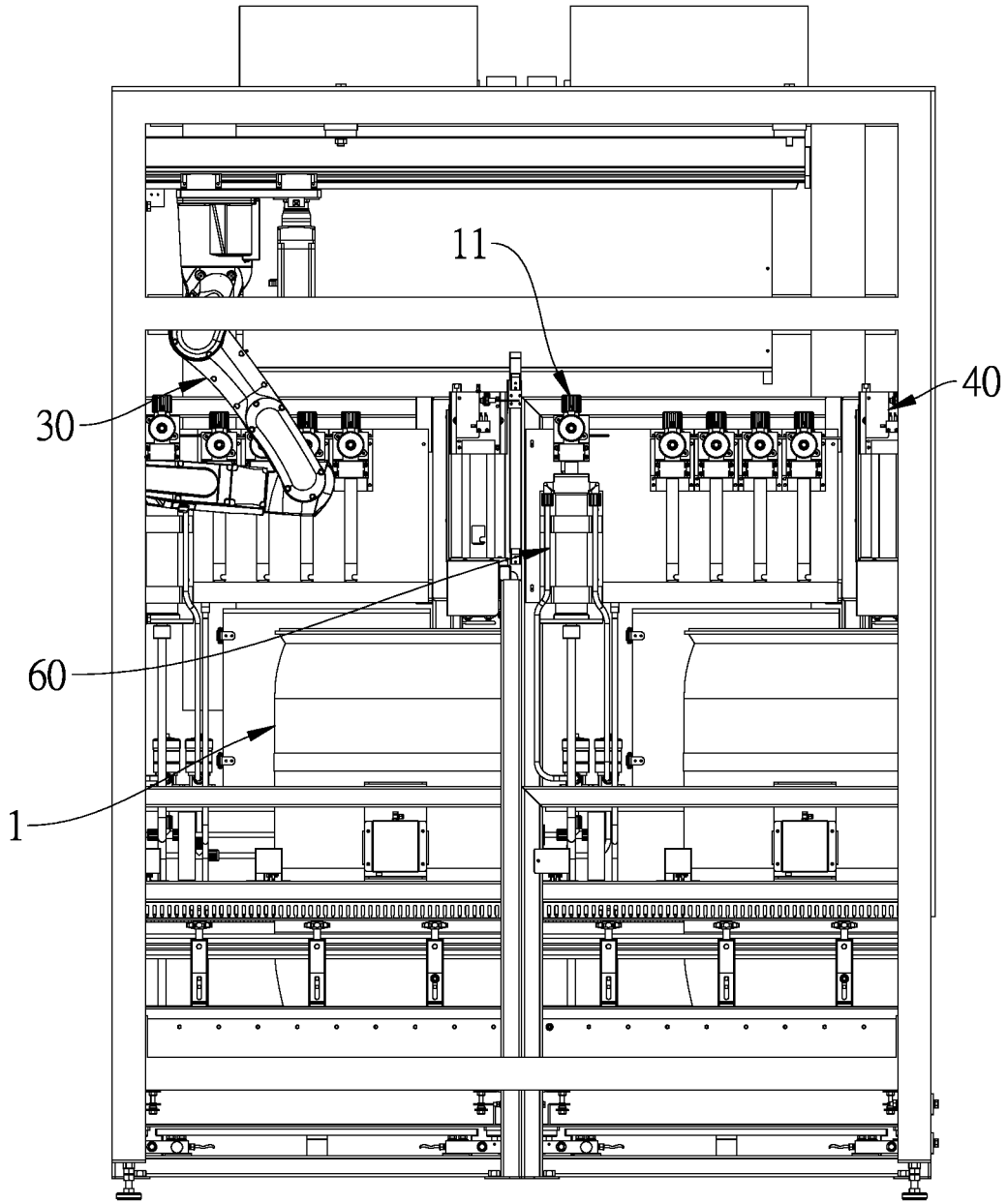

Step P2: As illustrated in FIG. 23, when the controlling unit 20 determines that the container 1 is filled properly, the lifting unit 40 drives the filling nozzle 11 to withdraw from the container 1 through the opening 2. After that, the gripping unit 30 takes down the filling nozzle 11 on the lifting unit 40 and moves the filling nozzle 11 to the cleansing unit 60 to clean. After the filling nozzle 11 is cleaned, the gripping unit 30 takes the filling nozzle 11 on the cleansing unit 60 back to the fixing frame 14.

In other embodiment, the step P1 and the step P2 of the method of filling liquid is optional. By merely conducting the step S1 and the step S2 of the method of filling liquid, the filing nozzle 11 could fill the container 1 with the liquid through the openings 2.

In the present invention, the machine assembly 10 of the automatic liquid filling system 100 could automatically fill the container 1 with liquid. When the container 1 is put into the filling zone A of the machine assembly 10, the controlling unit 20 controls the gripping unit 30 to pick up one of the filling nozzles 11 to make the filling nozzle 11 to fill the container 1 with the liquid, thereby reducing the required manpower of filling the container 1. Furthermore, the filling zone A of the machine assembly 10 could simultaneously receive a plurality of containers 1, the containers 1 could be filled by the filling nozzles 11 simultaneously to enhance the efficiency of filling. Additionally, before the container 1 enters the filling zone A, the barcode reader 70 at the buffering zone B could identify the barcode 3 on the container 1, so that the controlling unit 20 could control the gripping unit 30 to pick up one of the filling nozzles 11 that is suitable for the container 1 according to the liquid filling information, thereby reducing the manpower used for identify the container 1 and assuring to fill correct liquid into the container 1.

It must be pointed out that the embodiment described above is only a preferred embodiments of the present invention. All equivalent structures and method which employ the concepts disclosed in this specification and the appended claims should fall within the scope of the present invention.

What is claimed is:

1. automatic liquid filling system, comprising:

a machine assembly having a filling zone, wherein the filling zone is adapted to receive a container; the container has an opening;

the machine assembly includes a plurality of filling nozzles, and the filling nozzles are located in the filling zone;

a gripping unit disposed in the machine assembly;

the gripping unit includes a moving track and a robotic arm;

the robotic arm is controlled to move along the moving track; and a controlling unit disposed in the machine assembly and electrically connected to the gripping unit, wherein when the container is located in the filling zone, the controlling unit controls the robotic arm to move along the moving track and to pick up one of the filling nozzles to fill the container with liquid through the opening;

wherein the machine assembly has a fixing frame that is located in the filling zone;

a plurality of mounting seats are arranged on the fixing frame;

each of the filling nozzles is disposed on one of the mounting seats,;

wherein each of the mounting seats has a mounting hole;

each of the filling nozzles comprises a connector, a body portion, and an abutting portion;

the body portion is located below the connector, and the abutting portion is located at a side of the connector;

a positioning block is disposed on the abutting portion;

when the filling nozzle is disposed on the mounting seat, the abutting portion abuts against the mounting seat, and the positioning block is correspondingly engaged with the mounting hole, so that the body portion is suspended from the mounting seat;

wherein each of the filling nozzles comprises an engaging portion that extends in a radial direction of the connector;

the engaging portion is adapted to be connected to the robotic arm of the gripping unit.

2. The automatic liquid filling system as claimed in claim 1, wherein the fixing frame is disposed with a drip tray, and the drip tray is located below the mounting seats; when each of the filling nozzles is disposed on one of the mounting seats, the body portion of each of the filling nozzles suspends from the drip tray; the drip tray is adapted to collect liquid that is dripped down from the filling nozzles.

3. The automatic liquid filling system as claimed in claim 1, wherein the machine assembly comprises a conveyor seat and a weight sensor; the conveyor seat is located in the filling zone for driving the container to move; the weight sensor is located beneath the conveyor seat for measuring a weight change of the container and for determining a degree of filling for liquid in the container.

4. The automatic liquid filling system as claimed in claim 3, comprising an aligning unit that is located below the lifting unit and is electrically connected to the controlling unit; the aligning unit is adapted to position the container and to sense a position of the opening of the container; the aligning unit includes a clamping module that has a fixed arm and a telescopic arm; the fixed arm and the telescopic arm are located at two sides of the conveyor seat, respectively; the telescopic arm is movable relative to the fixed arm to abut against and to depart from the container; when the container is located in the filling zone, the telescopic arm moves toward the container to make the container be clamped between the telescopic arm and the fixed arm.

5. The automatic liquid filling system as claimed in claim 4, wherein the aligning unit includes a sensor module, wherein the sensor module is located above the clamping module;

the sensor module comprises a sensor, wherein the sensor has a sensing portion and is adapted to sense the position of the opening of the container.

6. The automatic liquid filling system as claimed in claim 5, wherein the fixed arm is disposed with a pair of fixed rollers, and the telescopic arm is disposed with a pair of transmitting rollers; the pair of transmitting rollers is connected to a driving motor; when the container is clamped between the telescopic arm and the fixed arm, a circumference of the container is contacted with circumferences of the pair of fixed rollers and circumference of the pair of transmitting rollers; the driving motor controls the pair of transmitting rollers to rotate, so that the pair of transmitting driver the container to rotate, thereby moving the opening of the container to a position corresponding to the sensing portion.

7. The automatic liquid filling system as claimed in claim 5, wherein the sensor module has a drip pan and a controller; the drip pan is located above the sensor; the controller is connected to the sensor and the drip pan and is able to move the sensor and the drip pan to move simultaneously away from or back to the controller.

8. The automatic liquid filling system as claimed in claim 1, comprising a lifting unit disposed in the filling zone of the machine assembly and electrically connected to the controlling unit; the lifting unit is adapted to receive the filling nozzle that is picked up by the gripping unit and to drive the filling nozzle to move up and down.

9. The automatic liquid filling system as claimed in claim 8, wherein the lifting unit comprises a positioning seat and a lifting seat, and the lifting seat drives the positioning seat to move up and down; the positioning seat is disposed with a positioning hole; when the container is located in the filling zone, the gripping unit is controlled by the controlling unit to pick up one of the plurality filling nozzles and mount the filling nozzle that is picked up to the positioning seat; when the filling nozzle that is picked up is mounted on the positioning seat, the positioning block is engaged with the positioning hole, thereby allowing the body portion of said filling nozzle is hung down from the positioning seat; after that, the lifting seat drives the filling nozzle on the positioning seat to move toward the container and to insert through the opening of the container.

10. The automatic liquid filling system as claimed in claim 8, comprising a cleansing unit disposed in the filling zone of the machine assembly and electrically connected to the controlling unit; the cleansing unit is adapted to receive the filling nozzle taken down from the lifting unit and to clean the body portion of the filling nozzle.

11. The automatic liquid filling system as claimed in claim 10, wherein the cleansing unit comprises a cylinder and a connecting portion; the cylinder has a cleaning space inside;

connecting portion is connected to the cylinder; the connecting portion has an axial hole that communicates with the cleaning space, wherein the axial hole is provided for allowing the body portion of the filling nozzle to insert into the cleaning space.

12. The automatic liquid filling system as claimed in claim 11, wherein the cleansing unit comprises an evacuating portion, a liquid inlet, and a gas inlet; the evacuating portion is located at the cylinder and communicates with the cleaning space; the evacuating portion and the axial hole are coaxial; the liquid inlet and the gas inlet are located on a circumference of the connecting portion and communicate with the cleaning space; when the filling nozzle is mounted in the cleansing unit, the cleansing unit is controlled to allow cleaning liquid to be input through the liquid inlet to clean the body portion of the filling nozzle; the evacuating portion evacuates the cleaning liquid in the cleaning space out, and then the cleansing unit is controlled to allow air to be input through the gas inlet to the cleaning space to dry the body portion of the filling nozzle.

13. The automatic liquid filling system as claimed in claim 12, wherein the connecting portion has a converging space inside; each of the liquid inlet and the gas inlet communicates with the converging space; the connecting portion has an annular opening at a side of the connecting portion that faces the cylinder; the annular opening surrounds the axial hole and communicates with the cleaning space and the converging space.

14. The automatic liquid filling system as claimed in claim 1, comprising a conveyor unit located out of the machine assembly and having a conveying track and a transferring track; the conveying track is adapted to transmit the container; and the transferring track is connected between the conveying track and the filling zone of the machine assembly; the transferring track is adapted to receive the container that is conveyed by the conveying track and to convey the container to the filling zone of the machine assembly.

15. The automatic liquid filling system as claimed in claim 1, wherein the container has a barcode; the machine assembly has a buffering zone that is connected to the filling zone;

the buffering zone is disposed with a barcode reader, wherein the barcode reader is electrically connected to the controlling unit and is adapted to read the barcode on the container to receive a liquid filling information; the controlling unit controls the gripping unit to pick up corresponding one of the filling nozzles in accordance with the liquid filling information.

16. A method of filling liquid, comprising: providing the automatic liquid filling system of claim 1, and further comprising:

step S1: putting the container into the filling zone of the machine assembly; and step S2: controlling the robotic arm of the gripping unit by the controlling unit to pick up one of the plurality of filling nozzles to fill the container with liquid through the opening of the container, wherein the robotic arm is movable along the moving track.

17. The method of filling liquid as claimed in claim 16, wherein in step S1, before the container enters into the filling zone, the container passes through a buffering zone; when the container is in the buffering zone, a barcode reader identified a barcode on the container to generate a liquid filling information; the controlling unit controls the gripping unit to pick up corresponding one of the filling nozzles in accordance with the liquid filling information.

18. The method of filling liquid as claimed in claim 16, comprising step P1 between step S1 and step S2, wherein in step P1, when the container is located in the filling zone, the container is clamped and positioned by a clamping module of an aligning unit; the container is driven to rotate by the clamping module; during a process of rotating of the container, a sensor of the aligning unit sense a position of the opening of the container.

19. The method of filling liquid as claimed in claim 16, wherein in step S2, the gripping unit picks up one of the plurality of filling nozzles and mounts the filling nozzle that is picked up to a lifting unit; the filling nozzle on the lifting unit is driven by the lifting unit to insert through the opening of the container to fill the container with liquid.

20. The method of filling liquid as claimed in claim 19, comprising step P2 after step S2, wherein when the container is filled completely, the lifting unit drives the filling nozzle on the lifting unit to withdraw from the opening of the container, and the gripping unit takes the filling nozzle on the lifting unit down and then move the filling nozzle to a cleansing unit to clean.

* * * * *